US008798495B2

(12) United States Patent
Koide et al.

(10) Patent No.: US 8,798,495 B2
(45) Date of Patent: Aug. 5, 2014

(54) IMAGE FORMING APPARATUS AND IMAGE FORMING METHOD WITH CONTROLLABLE SUCTION

(75) Inventors: Hiroyuki Koide, Kanagawa (JP); Katsunori Kikuchihara, Kanagawa (JP); Kazuyuki Yagata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 469 days.

(21) Appl. No.: 13/092,660

(22) Filed: Apr. 22, 2011

(65) Prior Publication Data

US 2012/0114368 A1 May 10, 2012

(30) Foreign Application Priority Data

Nov. 8, 2010 (JP) ..... 2010-250092

(51) Int. Cl.
*G03G 15/16* (2006.01)

(52) U.S. Cl.
USPC ..... 399/101; 399/343; 399/345; 399/349; 399/350

(58) Field of Classification Search
USPC ..... 399/101, 343, 345
See application file for complete search history.

(56) References Cited

U.S. PATENT DOCUMENTS

| | | | | |
|---|---|---|---|---|
| 4,054,380 | A * | 10/1977 | Donohue et al. | 700/27 |
| 7,251,448 | B2 * | 7/2007 | Pozniakas et al. | 399/350 |
| 7,319,841 | B2 * | 1/2008 | Bateman et al. | 399/345 |
| 8,385,770 | B2 * | 2/2013 | Yamada et al. | 399/101 |
| 8,503,903 | B2 * | 8/2013 | Yamada et al. | 399/101 |
| 8,630,562 | B2 * | 1/2014 | Tokunaga et al. | 399/101 |
| 2004/0022554 | A1 * | 2/2004 | Fina et al. | 399/102 |
| 2007/0189802 | A1 * | 8/2007 | Maeda et al. | 399/101 |
| 2007/0230989 | A1 | 10/2007 | Maeda et al. | |
| 2008/0056758 | A1 * | 3/2008 | Kawamata | 399/101 |
| 2012/0107013 | A1 * | 5/2012 | Kaneyama et al. | 399/101 |
| 2012/0114366 | A1 * | 5/2012 | Kaneyama et al. | 399/92 |
| 2012/0114367 | A1 * | 5/2012 | Yagata et al. | 399/101 |
| 2012/0114369 | A1 * | 5/2012 | Tokunaga et al. | 399/101 |

FOREIGN PATENT DOCUMENTS

| | | | |
|---|---|---|---|
| JP | 08-095458 | A | 4/1996 |
| JP | 2002-278312 | A | 9/2002 |

* cited by examiner

*Primary Examiner* — David Gray
*Assistant Examiner* — Geoffrey Evans
(74) *Attorney, Agent, or Firm* — Sughrue Mion, PLLC

(57) ABSTRACT

An image forming apparatus includes a housing provided with an opening opposed to a developer carrying member that carries developer; a collecting member provided along a downstream edge of the opening in a transporting direction of the developer and capable of coming into contact with and separating from the developer carrying member; a sealing member provided along an upstream edge of the opening in the transporting direction; a suction member that sucks air from the opening; a suction path provided between the opening and the suction member; an opening-closing unit that opens or closes the suction path; and a controller that controls the opening-closing unit so as to open the suction path at a time that is before separation of the collecting member from the developer carrying member and a predetermined time period after the time of contact between the collecting member and the developer carrying member.

15 Claims, 14 Drawing Sheets

IMAGE FORMING APPARATUS AND IMAGE FORMING METHOD WITH CONTROLLABLE SUCTION

CROSS-REFERENCE TO RELATED APPLICATIONS

This application is based on and claims priority under 35 USC 119 from Japanese Patent Application No. 2010-250092 filed Nov. 8, 2010.

BACKGROUND

The present invention relates to an image forming apparatus and an image forming method.

SUMMARY

According to an aspect of the invention, there is provided an image forming apparatus including a housing provided with an opening opposed to a developer carrying member that carries and transports developer; a collecting member provided along an edge of the opening at a downstream end of the opening in a transporting direction, in which the developer carrying member transports the developer, the collecting member being capable of coming into contact with and separating from the developer carrying member; a sealing member provided along an edge of the opening at an upstream end of the opening in the transporting direction; a suction member that sucks air from the opening; a suction path provided between the opening and the suction member; an opening-closing unit provided in the suction path, the opening-closing unit opening or closing the suction path; and a controller that controls the opening-closing unit so as to open the suction path in a closed state at a time that is before separation of the collecting member from the developer carrying member and a predetermined time period after the time of contact between the collecting member and the developer carrying member.

BRIEF DESCRIPTION OF THE DRAWINGS

An exemplary embodiment of the present invention will be described in detail based on the following figures, wherein.

DETAILED DESCRIPTION

Figure 1:
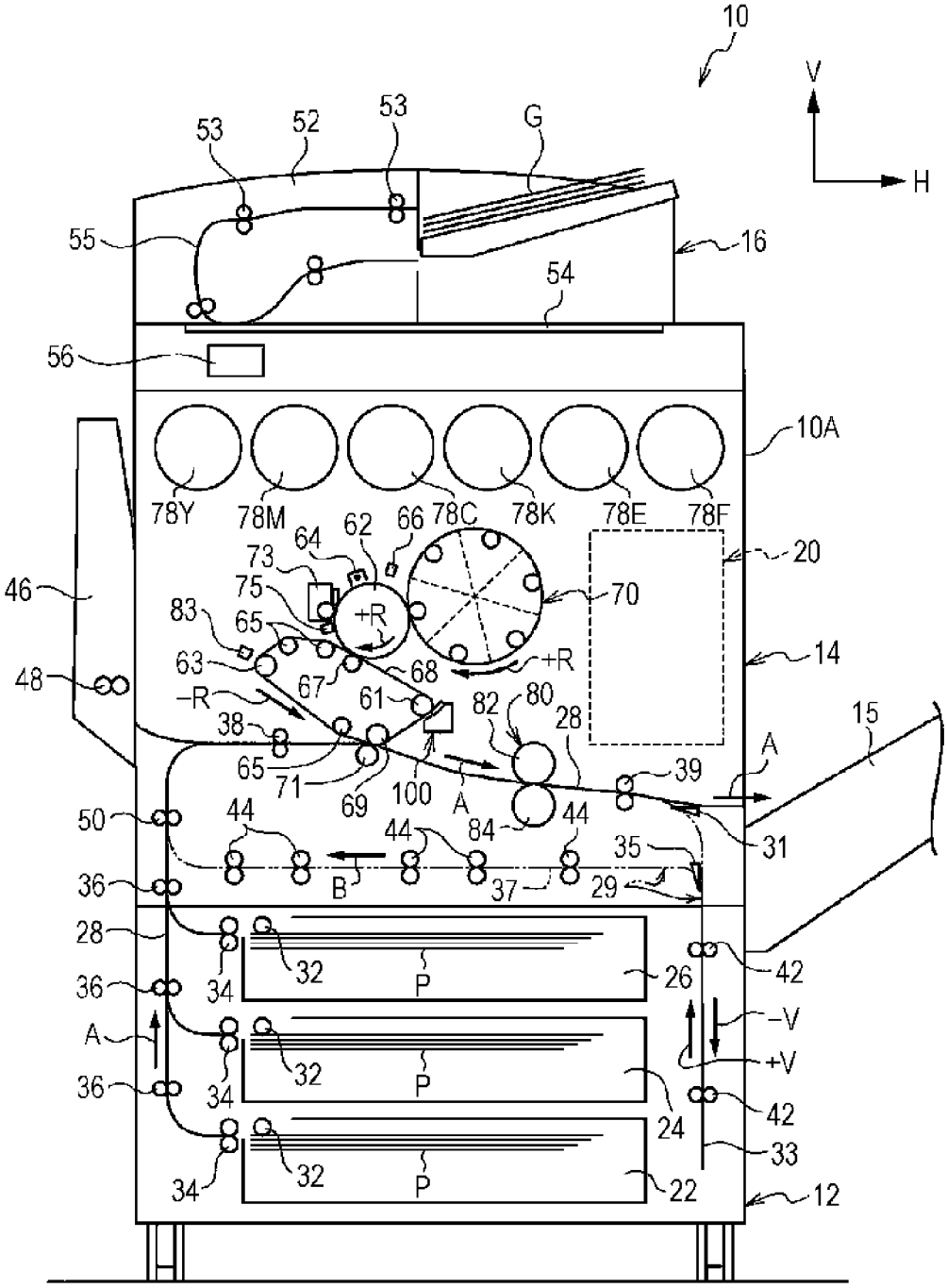
FIG. 1 illustrates the overall structure of an image forming apparatus according to an exemplary embodiment.

An exemplary embodiment of the present invention will be described in detail with reference to the drawings. In FIG. 1, the direction shown by arrow V is defined as an upward direction (vertical direction) with respect to an image forming apparatus 10, and the direction shown by arrow H is defined as a rightward direction (horizontal direction) with respect to the image forming apparatus 10. In addition, the side visible in FIG. 1 is defined as the front side of the image forming apparatus 10. In the present exemplary embodiment, recording paper P is used as an example of recording medium. In the following description, upstream and downstream sides in a transporting direction of the recording paper P are sometimes referred to simply as "upstream side" and "downstream side", respectively.

Referring to FIG. 1, the image forming apparatus 10 includes, in order from bottom to top in the vertical direction, a sheet storing unit 12 in which the recording paper P is stored; an image forming unit 14 which is located above the sheet storing unit 12 and forms images on sheets of recording paper P fed from the sheet storing unit 12; and an original-document reading unit 16 which is located above the image forming unit 14 and reads an original document G. The image forming apparatus 10 also includes a controller 20 that is provided in the image forming unit 14 and controls the operation of each part of the image forming apparatus 10.

The sheet storing unit 12 includes a first storage unit 22, a second storage unit 24, and a third storage unit 26 in which sheets of recording paper P having different sizes are stored. Each of the first storage unit 22, the second storage unit 24, and the third storage unit 26 are provided with a feeding roller 32 that feeds the stored sheets of recording paper P to a transport path 28 in the image forming apparatus 10. Pairs of transporting rollers 34 and 36 that transport the sheets of recording paper P one at a time are provided along the transport path 28 in an area on the downstream of each feeding roller 32.

In addition, a pair of transporting rollers 50 are provided downstream of the transporting rollers 36 near the third storage unit 26. The transporting rollers 50 are arranged to guide the sheets of recording paper P that have been transported from a reverse transport path 29, which will be described below, into the transport path 28. A pair of positioning rollers 38 are provided downstream of the transporting rollers 50. The positioning rollers 38 temporarily stops each sheet of recording paper P and feeds the sheet toward a second transfer position, which will be described below, at a predetermined timing.

In the front view of the image forming apparatus 10, a part of the transport path 28 that is upstream of the transporting rollers 50 extends vertically along a straight line. A downstream part of the transport path 28 including the positioning rollers 38 extends from the left side to the right side of the image forming unit 14. More specifically, the downstream part of the transport path 28 extends along a substantially straight line to a paper output unit 15 provided on the right side of an apparatus body 10A. The reverse transport path 29, which is provided for reversing and transporting the sheets of recording paper P, is located below the downstream part of the transport path 28 including the positioning rollers 38.

The reverse transport path 29 includes a first guiding member 31 that guides the sheets of recording paper P from the transport path 28 to the reverse transport path 29; a reversing unit 33 which extends vertically along a straight line from the lower right area of the image forming unit 14 to the lower right area of the sheet storing unit 12; a second guiding member 35 that guides the sheets of recording paper P that have been transported by the reversing unit 33 from the reversing unit 33 to a transporting unit 37, which will be described below; and the transporting unit 37 that transports the sheet of recording paper P guided by the second guiding member 35.

A downstream part of transporting unit 37 joins the transport path 28 in the area between the transporting rollers 36 near the third storage unit 26 and the transporting rollers 50. The reversing unit 33 is provided with plural pairs of transporting rollers 42 that are arranged with predetermined intervals therebetween, and the transporting unit 37 is provided with plural pairs of transporting rollers 44 that are arranged with predetermined intervals therebetween.

The first guiding member 31 has a substantially triangular shape in front view, and a point end of the first guiding member 31 is moved by a driving unit (not shown) to one of the transport path 28 and the reverse transport path 29. Thus, each sheet of recording paper P is guided along one of the transport path 28 and the reverse transport path 29. Similarly, the second guiding member 35 has a substantially triangular shape in front view, and a point end of the second guiding member 35 is moved by a driving unit (not shown) to one of the reversing unit 33 and the transporting unit 37. Thus, each sheet of recording paper P is guided along one of the reversing unit 33 and the transporting unit 37.

A foldable manual sheet-feeding unit 46 is provided on the left side of the apparatus body 10A. When a sheet of recording paper P is supplied from the manual sheet-feeding unit 46, the sheet is transported by transporting rollers 48 and is inserted into the transport path 28 at a position downstream of the transporting rollers 50 and upstream of the positioning rollers 38.

The original-document reading unit 16 includes a document transport device 52 that automatically transports the sheets of the original document G one at a time; a platen glass 54 which is located below the document transport device 52 and on which the sheets of the original document G are placed one at a time; and an original-document reading device 56 that scans each sheet of the original document G while the sheet is being transported by the document transport device 52 or placed on the platen glass 54.

The document transport device 52 includes an automatic transport path 55 along which pairs of transporting rollers 53 are arranged. A part of the automatic transport path 55 is arranged such that each sheet of the original document G moves along the top surface of the platen glass 54. The original-document reading device 56 scans each sheet of the original document G that is being transported by the document transport device 52 while being stationary at the left edge of the platen glass 54. Alternatively, the original-document reading device 56 scans each sheet of the original document G placed on the platen glass 54 while moving rightward.

The image forming unit 14 includes a cylindrical photoconductor 62, which is an example of a latent-image carrying member. The photoconductor 62 is arranged in a substantially central area of the apparatus body 10A such that an axial direction thereof extends in the front-back direction of the apparatus body 10A. The photoconductor 62 is rotated in the direction shown by arrow +R (clockwise in FIG. 1) by a driving unit (not shown), and carries an electrostatic latent image formed by irradiation with light. In addition, a corotron charging member 64 that charges the outer peripheral surface of the photoconductor 62 is provided above the photoconductor 62 so as to face the outer peripheral surface of the photoconductor 62.

An exposure device 66 is provided so as to face the outer peripheral surface of the photoconductor 62 at a position downstream of the charging member 64 in the rotational direction of the photoconductor 62. The exposure device 66 includes a light emitting diode (LED). The outer peripheral surface of the photoconductor 62 that has been charged by the charging member 64 is irradiated with light (exposed to light) by the exposure device 66 on the basis of an image signal corresponding to each color of toner. Thus, an electrostatic latent image is formed.

The exposure device 66 is not limited to those including the LED. For example, the exposure device 66 may be structured such that the outer peripheral surface of the photoconductor 62 is scanned with a laser beam by using a polygon mirror. A rotation-switching developing device 70, which is an example of a developing unit, is provided downstream of a position where the photoconductor 62 is irradiated with light by the exposure device 66 in the rotational direction of the photoconductor 62. The developing device 70 visualizes the electrostatic latent image on the outer peripheral surface of the photoconductor 62 by developing the electrostatic latent image with toner of each color. The developing device 70 will be described in detail below.

An intermediate transfer unit 60 (see FIG. 2) is provided downstream of the developing device 70 in the rotational direction of the photoconductor 62 and below the photoconductor 62. A toner image (developer image) formed on the outer peripheral surface of the photoconductor 62 is transferred onto the intermediate transfer unit 60 in a first transfer process. The intermediate transfer unit 60 includes an endless intermediate transfer belt (intermediate transfer body) 68, which is an example of a developer carrying member. The intermediate transfer belt 68 rotates in the direction shown by arrow −R (counterclockwise in FIG. 1).

The intermediate transfer belt 68 is wound around a driving roller 61 that is rotated by the controller 20, a tension-applying roller 63 that applies a tension to the intermediate transfer belt 68, plural transporting rollers 65 that are in contact with the inner peripheral surface (back surface) of the intermediate transfer belt 68 and are rotationally driven, and an auxiliary roller 69 that is in contact with the inner peripheral surface of the intermediate transfer belt 68 at the second transfer position, which will be described below, and is rotationally driven.

A first transfer roller 67 is opposed to the photoconductor 62 with the intermediate transfer belt 68 interposed therebetween. The first transfer roller 67 transfers the toner image formed on the outer peripheral surface of the photoconductor 62 onto the outer peripheral surface (front surface) of the intermediate transfer belt 68.

The first transfer roller 67 is in contact with the inner peripheral surface of the intermediate transfer belt 68 at a position downstream of the position where the photoconductor 62 is in contact with the intermediate transfer belt 68 in the moving direction of the intermediate transfer belt 68. The first transfer roller 67 receives electricity from a power source (not shown), so that a potential difference is generated between the first transfer roller 67 and the photoconductor 62, which is grounded. Thus, the first transfer process is carried out in which the toner image on the photoconductor 62 is transferred onto the outer peripheral surface of the intermediate transfer belt 68.

A second transfer roller 71, which is an example of a transfer unit, is opposed to the auxiliary roller 69 with the intermediate transfer belt 68 interposed therebetween. The second transfer roller 71 performs a second transfer process in which toner images that have been transferred onto the outer peripheral surface of the intermediate transfer belt 68 in the first transfer process are transferred onto the sheet of recording paper P. The position between the second transfer roller 71 and the auxiliary roller 69 serves as the second transfer position at which the toner images are transferred onto the sheet of recording paper P. The second transfer roller 71 is provided with a retracting mechanism (not shown) that allows the second transfer roller 71 to move toward and away from (come into contact with and separate from) the outer peripheral surface of the intermediate transfer belt 68.

The second transfer roller 71 is separated from the outer peripheral surface of the intermediate transfer belt 68 until the toner images of respective colors are all transferred onto the outer peripheral surface of the intermediate transfer belt 68 in the first transfer process. After the toner images of the respective colors are all transferred onto the outer peripheral surface of the intermediate transfer belt 68, the second transfer roller 71 comes into contact with the outer peripheral surface of the intermediate transfer belt 68. Then, the second transfer roller 71 receives electricity from a power source (not shown), so that a potential dereference is generated between the second transfer roller 71 and the auxiliary roller 69, which is grounded. Thus, the second transfer process is carried out in which the toner images on the outer peripheral surface of the intermediate transfer belt 68 are transferred onto the sheet of recording paper P.

A cleaning device 100, which is an example of a developer collecting device, is opposed to the driving roller 61 with the intermediate transfer belt 68 interposed therebetween. The cleaning device 100 collects residual toner T (see FIGS. 13A and 13B) that remains on the outer peripheral surface of the intermediate transfer belt 68 after the second transfer process. The cleaning device 100 will be described in detail below.

A position detection sensor 83 is opposed to the tension-applying roller 63 at a position outside the intermediate transfer belt 68. The position detection sensor 83 detects a predetermined reference position on the outer peripheral surface of the intermediate transfer belt 68 by detecting a mark (not shown) on the outer peripheral surface of the intermediate transfer belt 68. The position detection sensor 83 outputs a position detection signal that serves as a reference for the time to start an image forming process.

A cleaning device 73 is provided downstream of the first transfer roller 67 in the rotational direction of the photoconductor 62. The cleaning device 73 removes residual toner and the like that remain on the outer peripheral surface of the photoconductor 62 instead of being transferred onto the outer peripheral surface of the intermediate transfer belt 68 in the first transfer process.

Figure 2:
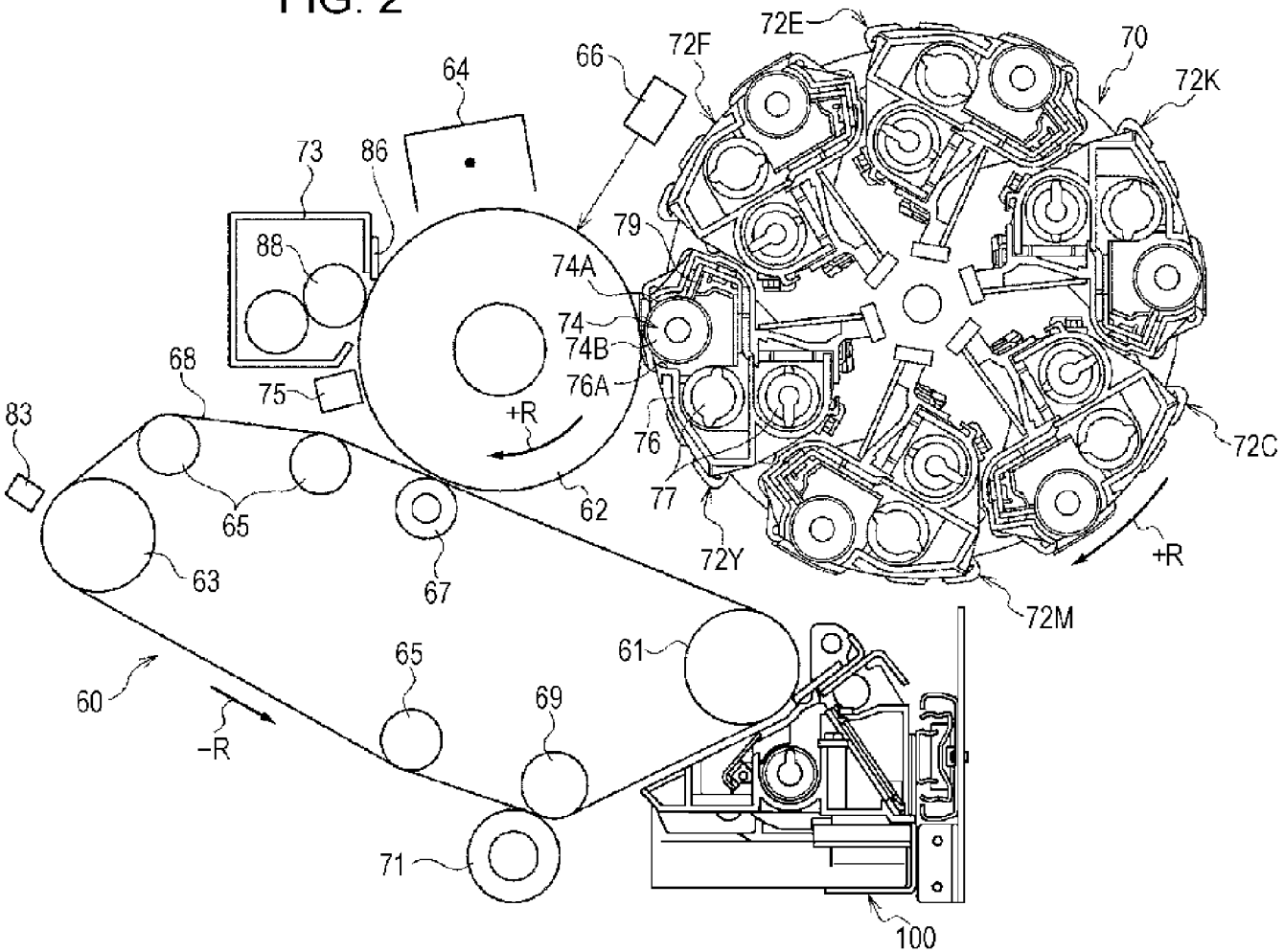
FIG. 2 illustrates the structure of an image forming unit according to the exemplary embodiment.

As illustrated in FIG. 2, the cleaning device 73 collects the residual toner and the like with a cleaning blade 86 and a brush roller 88 that are in contact with the outer peripheral surface of the photoconductor 62. An discharge device 75 is provided upstream of the cleaning device 73 and downstream of the first transfer roller 67 in the rotational direction of the photoconductor 62. The discharge device 75 removes the electric charge by irradiating the outer peripheral surface of the photoconductor 62 with light.

The discharge device 75 removes the electric charge by irradiating the outer peripheral surface of the photoconductor 62 with light before the residual toner and the like are collected by the cleaning device 73. Accordingly, the electrostatic adhesion force applied to the residual toner and the like on the outer peripheral surface of the photoconductor 62 is reduced and the collection rate of the residual toner and the like is increased. An additional discharge device for removing the electric charge on the outer peripheral surface of the photoconductor 62 after the collection of the residual toner and the like may be provided downstream of the cleaning device 73 and upstream of the charging member 64 in the rotational direction of the photoconductor 62.

As illustrated in FIG. 1, the second transfer position at which the toner images are transferred onto the sheet of recording paper P by the second transfer roller 71 is at an intermediate position of the transport path 28. A fixing device 80 is provided on the transport path 28 at a position downstream of the second transfer roller 71 in the transporting direction of the sheet of recording paper P (direction shown by arrow A). The fixing device 80 fixes the toner images that have been transferred onto the sheet of recording paper P by the second transfer roller 71.

The fixing device 80 includes a heating roller 82 and a pressing roller 84. The heating roller 82 includes a heat source which generates heat when electricity is supplied thereto, and is disposed at the side of the sheet of recording paper P at which the toner images are formed (upper side). The pressing roller 84 is positioned below the heating roller 82, and presses the sheet of recording paper P against the outer peripheral surface of the heating roller 82. Transporting rollers 39 that transport the sheet of recording paper P to the paper output unit 15 or the reversing unit 33 are provided on the transport path 28 at a position downstream of the fixing device 80 in the transporting direction of the sheet of recording paper P.

Toner cartridges 78Y, 78M, 78C, 78K, 78E, and 78F that respectively contain yellow (Y) toner, magenta (M) toner, cyan (C) toner, black (K) toner, toner of a first specific color (E), and toner of a second specific color (F) are arranged in the horizontal direction in a replaceable manner in an area below the original-document reading device 56 and above the developing device 70.

The first and second specific colors E and F may be selected from specific colors (including transparent) other than yellow, magenta, cyan, and black. Alternatively, the first and second specific colors E and F are not selected. When the first and second specific colors E and F are selected, the developing device 70 performs the image forming process using six colors, which are Y, M, C, K, E, and F. When the first and second specific colors E and F are not selected, the developing device 70 performs the image forming process using four colors, which are Y, M, C, and K.

In the present exemplary embodiment, the case in which the image forming process is performed using the four colors, which are Y, M, C, and K, and the first and second specific colors E and F are not used will be described as an example. However, as another example, the image forming process may be performed using five colors, which are Y, M, C, K, and one of the first and second specific colors E and F.

The developing device 70 will now be described.

As illustrated in FIG. 2, the developing device 70 includes developing units 72Y, 72M, 72C, 72K, 72E, and 72F corresponding to the respective colors, which are yellow (Y), magenta (M), cyan (C), black (K), the first specific color (E), and the second specific color (F), respectively. The developing units 72Y, 72M, 72C, 72K, 72E, and 72F are arranged in that order in a circumferential direction (counterclockwise). The developing device 70 is rotated by a motor (not shown), which functions as a rotational drive source, in steps of 60°. Accordingly, one of the developing units 72Y, 72M, 72C, 72K, 72E, and 72F that is to perform a developing process is selectively opposed to the outer peripheral surface of the photoconductor 62.

The developing units 72Y, 72M, 72C, 72K, 72E, and 72F have similar structures. Therefore, only the developing unit 72Y will be described, and explanations of the other developing units 72M, 72C, 72K, 72E, and 72F will be omitted.

The developing unit 72Y includes a casing member 76, which serves as a base body. The casing member 76 is filled with developer (not shown) including toner and carrier. The developer is supplied from the toner cartridge 78Y (see FIG. 1) through a toner supply channel (not shown).

The casing member 76 has a rectangular opening 76A that is opposed to the outer peripheral surface of the photoconductor 62. A developing roller 74 is disposed in the opening 76A so as to face the outer peripheral surface of the photoconductor 62. A plate-shaped regulating member 79, which regulates the thickness of a developer layer, is provided along the longitudinal direction of the opening 76A at a position near the opening 76A in the casing member 76.

The developing roller 74 includes a rotatable cylindrical developing sleeve 74A and a magnetic unit 74B fixed to the inner surface of the developing sleeve 74A and including plural magnetic poles. A magnetic brush made of the developer (carrier) is formed as the developing sleeve 74A is rotated, and the thickness of the magnetic brush is regulated by the regulating member 79. Thus, the developer layer is formed on the outer peripheral surface of the developing sleeve 74A. The developer layer on the outer peripheral surface of the developing sleeve 74A is moved to the position where the developing sleeve 74A faces the photoconductor 62. Accordingly, the toner adheres to the latent image (electrostatic latent image) formed on the outer peripheral surface of the photoconductor 62. Thus, the latent image is developed.

Two helical transporting augers 77 are rotatably arranged in parallel to each other in the casing member 76. The two transporting augers 77 rotate so as to circulate the developer contained in the casing member 76 in the axial direction of the developing roller 74 (longitudinal direction of the developing unit 72Y).

Six developing rollers 74 are included in the respective developing units 72Y, 72M, 72C, 72K, 72E, and 72F, and are arranged along the circumferential direction so as to be separated form each other by 60° in terms of the central angle. When the developing units 72 are switched, the developing roller 74 in the newly selected developing unit 72 is caused to face the outer peripheral surface of the photoconductor 62.

The cleaning device 100 will now be described.

Referring to FIGS. 3A to 4B, the cleaning device 100 includes a housing 102, a cleaning blade 106, which is an example of a collecting member, and a sealing member 108. The housing 102 has a rectangular opening 104 that is opposed to the intermediate transfer belt 68. The cleaning blade 106 is provided at the upper side of the opening 104, and comes into contact with the intermediate transfer belt 68 to collect the residual toner T. The sealing member 108 is provided at the side opposite to the cleaning blade 106 (at the lower side of the opening 104), and comes into contact with the intermediate transfer belt 68 so as to seal a gap between the housing 102 and the intermediate transfer belt 68.

The cleaning device 100 further includes a suction unit 110 (see, for example, FIG. 10) that sucks in the residual toner T and the like on the intermediate transfer belt 68 into the housing 102, a filter 112 that is provided in the housing 102 to collect dust including the residual toner T, and a part of a retracting mechanism 130, which is an example of a moving unit. The retracting mechanism 130 moves the cleaning blade 106 and the sealing member 108 between a position at which they are in contact with the outer peripheral surface of the intermediate transfer belt 68 and a position at which they are separated from the outer peripheral surface of the intermediate transfer belt 68.

In the following description of each component in the housing 102, the longitudinal direction of the housing 102 and the opening 104 is defined as a Z-direction, the direction that is orthogonal to the Z-direction and extends along the plane including a bottom wall 102A (see FIGS. 3B and 4B) of the housing 102 is defined as an X-direction, and the height direction of the housing 102 that is orthogonal to the X-direction and the Z-direction is defined as a Y-direction. The Z-direction extends in the front-back direction of the image forming apparatus 10 in front view (see FIG. 1).

As illustrated in FIGS. 3A to 5, the housing 102 is shaped such that it is open at both ends in the Z-direction and at a left end of the top wall and a top end of the left side wall when viewed in the Z-direction. Side plates 114 are attached with screws to the housing 102 at the ends thereof in the Z-direction. A first movable member 116 made of a metal plate that is L-shaped in the X-Y plane is provided in the upper area of the housing 102 such that the longitudinal direction of the first movable member 116 extends in the Z-direction.

Figure 3A:
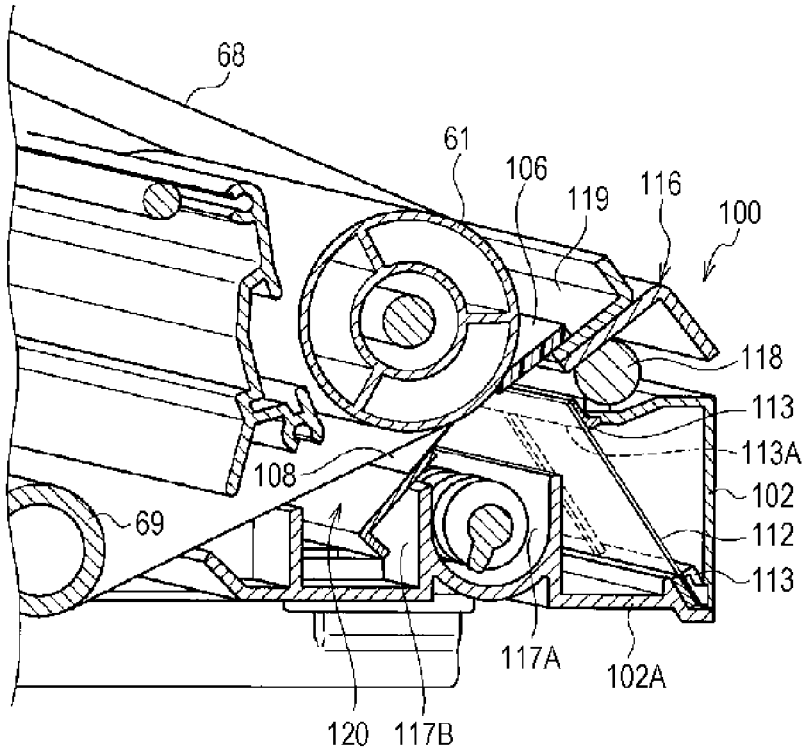
FIG. 3A is a perspective view illustrating the inner structure of a cleaning device when an intermediate transfer belt is in contact therewith.
Figure 3B:
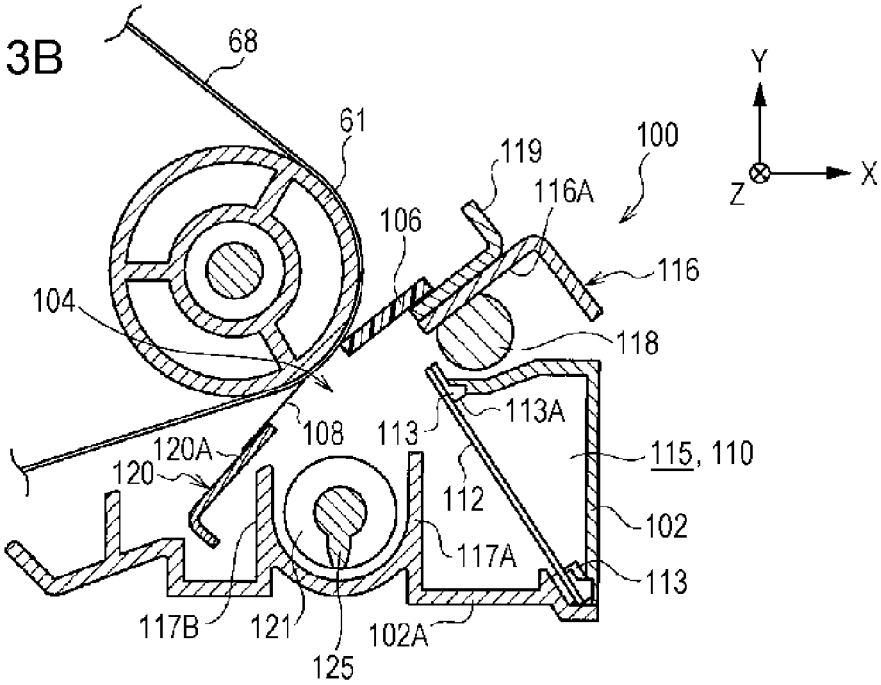
FIG. 3B is a sectional view illustrating the inner structure of the cleaning device when the intermediate transfer belt is in contact therewith.
Figure 4A:
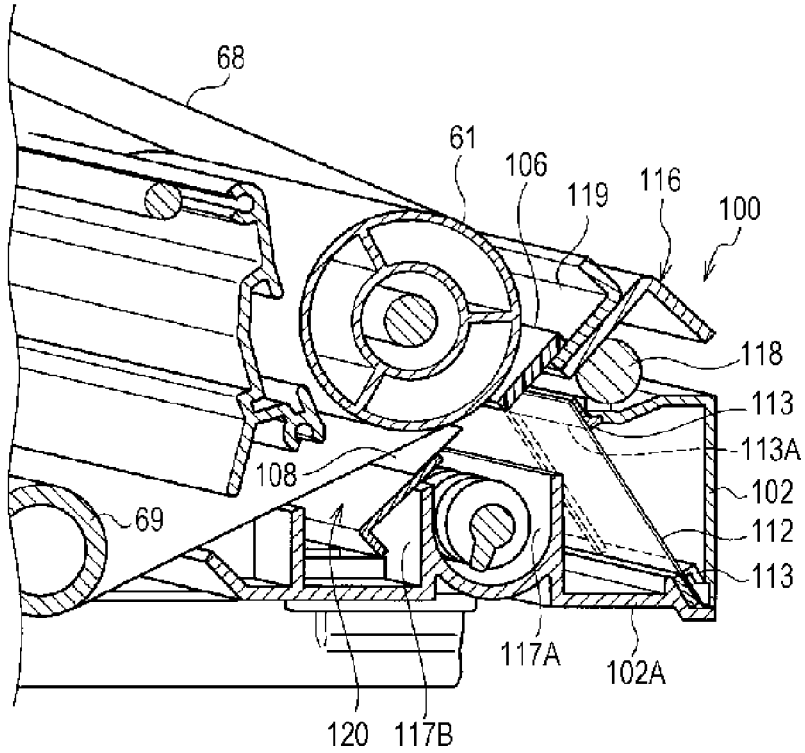
FIG. 4A is a perspective view illustrating the inner structure of the cleaning device when the intermediate transfer belt is separated therefrom.
Figure 4B:
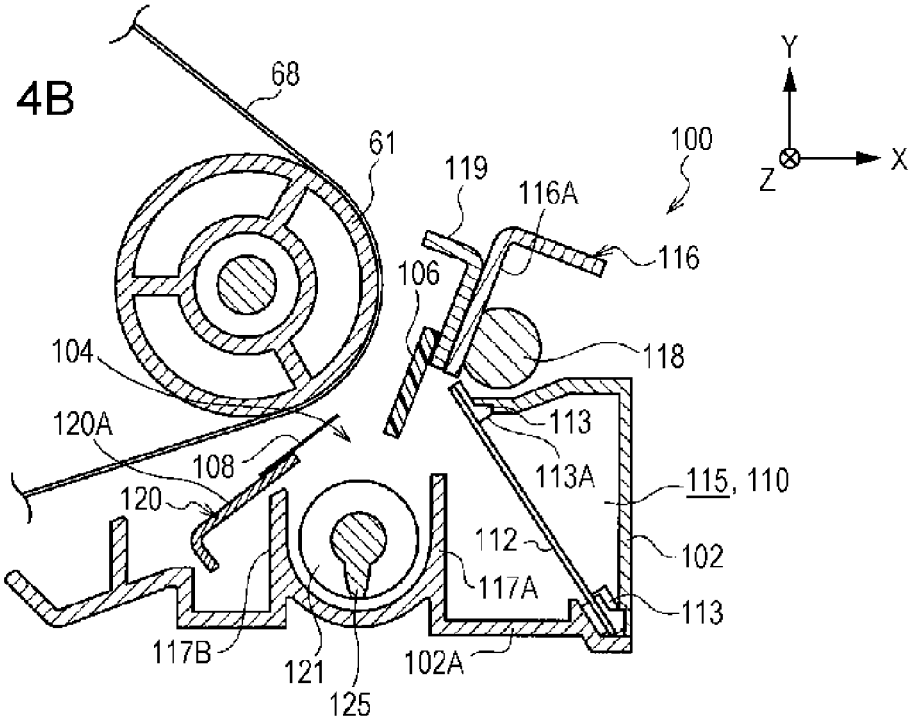
FIG. 4B is a sectional view illustrating the inner structure of the cleaning device when the intermediate transfer belt is separated therefrom.

FIGS. 3A and 3B illustrate the state in which the cleaning blade 106 and the sealing member 108 are in contact with the outer peripheral surface intermediate transfer belt 68, and FIGS. 4A and 4B illustrate the state in which the cleaning blade 106 and the sealing member 108 are separated from the outer peripheral surface intermediate transfer belt 68.

The first movable member 116 is arranged such that it is inverted-V-shaped in the X-Y plane, and includes an inclined portion 116A (portion that extends toward the lower left in FIGS. 3A to 4B). A supporting shaft 118 is fixed to the back surface (surface facing a suction path 115, which will be described below) of the inclined portion 116A such that the axial direction thereof extends in the Z-direction. The supporting shaft 118 is rotatably supported by bearings (not shown) provided on the side plates 114 at the ends thereof.

A supporting plate 119 made of a metal plate that is L-shaped in the X-Y plane is attached with screws to the front surface of the inclined portion 116A of the first movable member 116. An end portion of the cleaning blade 106 in the short-side direction thereof (downstream end in the transporting direction) is fixed to the bottom end of the supporting plate 119 by adhesion. The cleaning blade 106 is arranged so as to extend along the inclination direction of the inclined portion 116A.

The cleaning blade 106 is a plate made of resin that has a rectangular shape in plan view, and is attached to the supporting plate 119 such that the longitudinal direction of the cleaning blade 106 extends along the longitudinal direction of the opening 104. Thus, the cleaning blade 106 is provided along the edge of the opening 104 at the downstream end thereof in the transporting direction of the intermediate transfer belt 68 (direction shown by arrow –R).

When the retracting mechanism 130, which will be described below, is set to a contact state, the cleaning blade 106 is arranged such that a free end thereof (end that is not fixed to the supporting plate 119) is in contact with the intermediate transfer belt 68. In this state, the cleaning blade 106 collects the residual toner T on the intermediate transfer belt 68 into the housing 102.

A second movable member 120 made of an L-shaped metal plate is provided in the lower area of the housing 102 in the X-Y plane such that the longitudinal direction of the second movable member 120 extends in the Z-direction. The second movable member 120 is arranged such that it is inverted-V-shaped in the X-Y plane, and includes an inclined portion 120A (portion that extends toward the lower left in FIGS. 3A to 4B) in an upper area thereof. A rotatable supporting shaft (not shown) is attached to the back surface of the inclined portion 120A such that the axial direction thereof extends in the Z-direction.

Thus, the second movable member 120 is rotatably supported. The second movable member 120 is rotated (moved) in association with the movement of the first movable member 116 by the retracting mechanism 130. An end portion of the sealing member 108 in the short-side direction thereof (upstream end in the transporting direction) is fixed to the top end of the inclined portion 120A of the second movable member 120.

The sealing member 108 is, for example, a transparent film having a rectangular shape in plan view, and is attached to the second movable member 120 such that the sealing member 108 comes into contact with the intermediate transfer belt 68 along the edge of the opening 104 at the upstream end thereof in the transporting direction of the intermediate transfer belt 68.

When the retracting mechanism 130 is set to the contact state and the cleaning blade 106 is in contact with the intermediate transfer belt 68, the sealing member 108 is arranged such that a free end thereof (end that is not attached to the second movable member 120) is in contact with the intermediate transfer belt 68. In this state, the sealing member 108 seals the gap between the housing 102 and the intermediate transfer belt 68.

The sealing member 108 is disposed below the cleaning blade 106, and the end portion of the sealing member 108 is pointed toward the downstream in the moving direction of the intermediate transfer belt 68. Therefore, the sealing member 108 does not remove the residual toner T from the intermediate transfer belt 68.

The first movable member 116, the supporting shaft 118, the supporting plate 119, and the second movable member 120 form a part of the housing 102. The opening 104 is an open area that is formed in the housing 102 and that extends from the bottom end of the supporting plate 119 to the top end of the second movable member 120.

A filter 112 is disposed in the housing 102. The filter 112 is a fiber assembly, and is formed in a rectangular shape that is long in the longitudinal direction of the housing 102 (Z-direction). The filter 112 is bonded to an attachment member 113, which is attached to the housing 102.

The attachment member 113 is a frame member obtained by forming plural openings 113A of rectangular through holes in a rectangular plate along the longitudinal direction of the plate. The attachment member 113 is disposed below the supporting shaft 118 such that a lower portion of the attachment member 113 is farther away from the intermediate transfer belt 68 and the opening 104 than an upper portion thereof in the X-Y plane.

The attachment member 113 sections the housing 102 such that the suction path 115 having an inverted triangular shape in the X-Y plane is provided at the right side of the housing 102 in FIGS. 3B and 4B. The suction path 115 extends in the longitudinal direction of the housing 102. The suction path 115 forms a part of the suction unit 110. A pair of partition walls 117A and 117B are provided on the bottom wall 102A so as to stand upright in an area between the opening 104 and the first filter 112 in side view (X-Y plane) of the housing 102.

A transporting auger 121 is disposed in the lower area of the housing 102 in the space between the pair of partition walls 117A and 117B. The transporting auger 121 includes a rotating shaft 125 whose axial direction extends in the Z-direction and a helical blade 127 that is formed on the outer peripheral surface of the rotating shaft 125. The transporting auger 121 is rotated so as to transport the residual toner T collected in the housing 102 to one end thereof in the axial direction (longitudinal direction of the housing 102).

A driving unit (not shown) including a driving motor is provided at the back end of the transporting auger 121 in the Z-direction. The controller 20 (see FIG. 1) controls the driving unit so as to rotate the transporting auger 121 or stop the rotation thereof.

Figure 5:
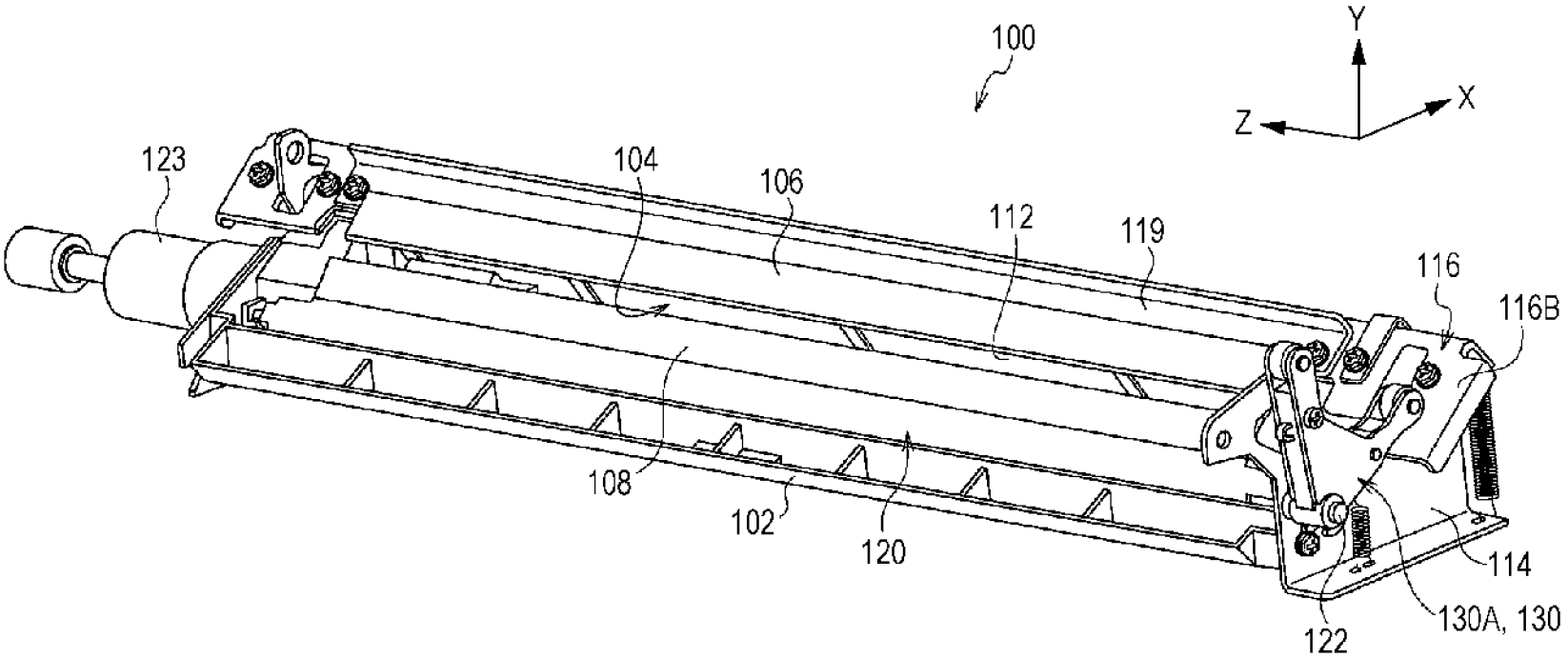
FIG. 5 is a perspective view of the cleaning device according to the exemplary embodiment.

As illustrated in FIG. 5, a cylindrical collection path 123 is provided at the back end of the housing 102 in the Z-direction. The residual toner T transported by the transporting auger 121 is guided to a collection tank (not shown) through the collection path 123.

As illustrated in FIGS. 5 to 8, the retracting mechanism 130 includes a first mechanism unit 130A provided at the front side in the Z-direction and a second mechanism unit 130B provided at the back side in the Z-direction. Side plates 131A and 131B are provided at the front and back sides, respectively, at positions near the ends of the intermediate transfer belt 68 in the Z-direction (width direction).

Figure 6:
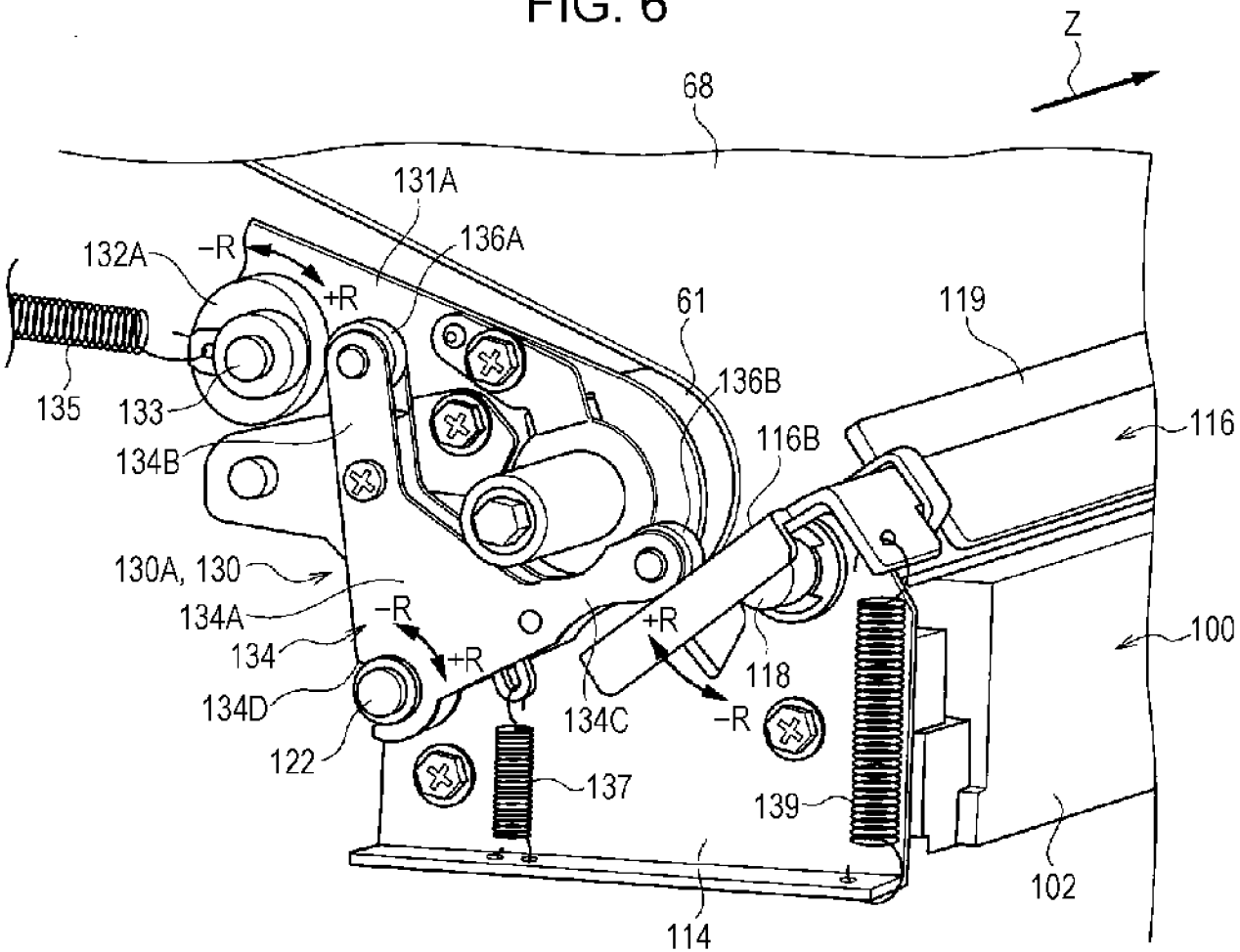
FIG. 6 is a perspective view of a retracting mechanism included in the cleaning device according to the exemplary embodiment.

As illustrated in FIG. 6, the first mechanism unit 130A includes an eccentric cam 132A rotated by the driving motor (the same motor as the driving motor that rotates the transporting auger 121) and a link member 134 provided on one of the side plates 114 of the cleaning device 100. The link member 134 moves the first movable member 116 and the second movable member 120 in response to the rotation of the eccentric cam 132A.

A shaft member 133 is rotatably provided on the side plates 131A and 131B (see FIGS. 7 and 8), and the eccentric cam 132A is attached to a first end (front end in the Z-direction) of the shaft member 133 that projects from the side plate 131A. The shaft member 133 is rotated by the above-described driving motor. A spring 135 is attached to the side plate 131A at one end thereof, and the other end of the spring 135 is attached to an eccentric portion of the eccentric cam 132A that is offset from the shaft member 133.

The link member 134 is substantially V-shaped in plan view, and includes two plates having the same size that are integrated with each other with a gap therebetween. More specifically, the link member 134 includes a base portion 134A having an inverted triangular shape, a first arm 134B that extends toward the upper left from the upper left part of the base portion 134A in front view, and a second arm 134C that extends toward the upper right from the upper right part of the base portion 134A in front view.

In addition, an arc-shaped cut portion 134D to which a support shaft 122 is fixed is formed in the base portion 134A at the lower end (at the vertex) thereof. Rollers 136A and 136B are rotatably provided at the top ends of the first arm 134B and the second arm 134C, respectively. The support shaft 122 is rotatably supported at both ends thereof in the axial direction by bearings (not shown) provided on the side plate 114 and the side plate 131B.

The link member 134 is movable (rotatable) around the support shaft 122 in the +R direction (clockwise in FIG. 6) and the −R direction (counterclockwise in FIG. 6). Accordingly, the first arm 134B and the second arm 134C are movable (rotated) in the +R direction and the −R direction.

A spring 137 is attached at one end thereof to the base portion 134A of the link member 134 at the side where the second arm 134C is provided. The other end of the spring 137 is attached to a bottom portion of the side plate 114. Thus, when the eccentric cam 132A is not in contact with the link member 134, the link member 134 receives a rotational force in the +R direction.

A spring 139 is attached at one end thereof to an end of the first movable member 116, and the other end of the spring 139 is attached to the bottom portion of the side plate 114. Thus, the first movable member 116 receives a rotational force in the +R direction. The roller 136B is in contact with a contact portion 116B, which is a flat surface of the first movable member 116 provided at the front end thereof.

The roller 136A comes into contact with the eccentric cam 132A when the eccentric cam 132A rotates in the +R direction, and moves away from the eccentric cam 132A when the eccentric cam 132A rotates in the −R direction. When the eccentric cam 132A comes into contact with the roller 136A and moves the link member 134 in the +R direction, the roller 136B pushes the contact portion 116B of the first movable member 116 and moves the first movable member 116 in the −R direction. Then, when the eccentric cam 132A moves away from the roller 136A, the first movable member 116 moves in the +R direction.

Figure 7:
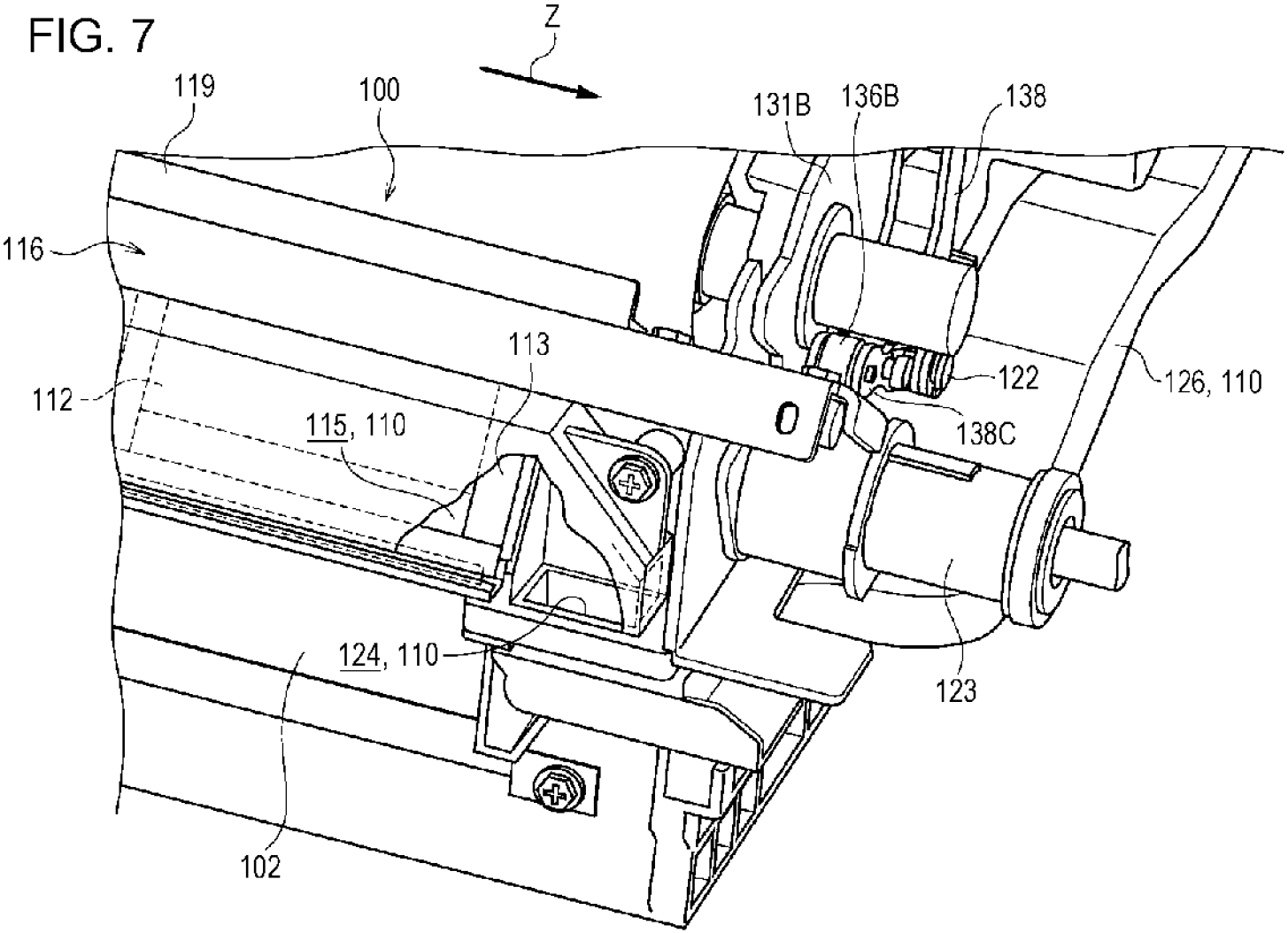
FIG. 7 is a perspective view of a first duct included in the cleaning device according to the exemplary embodiment.
Figure 8:
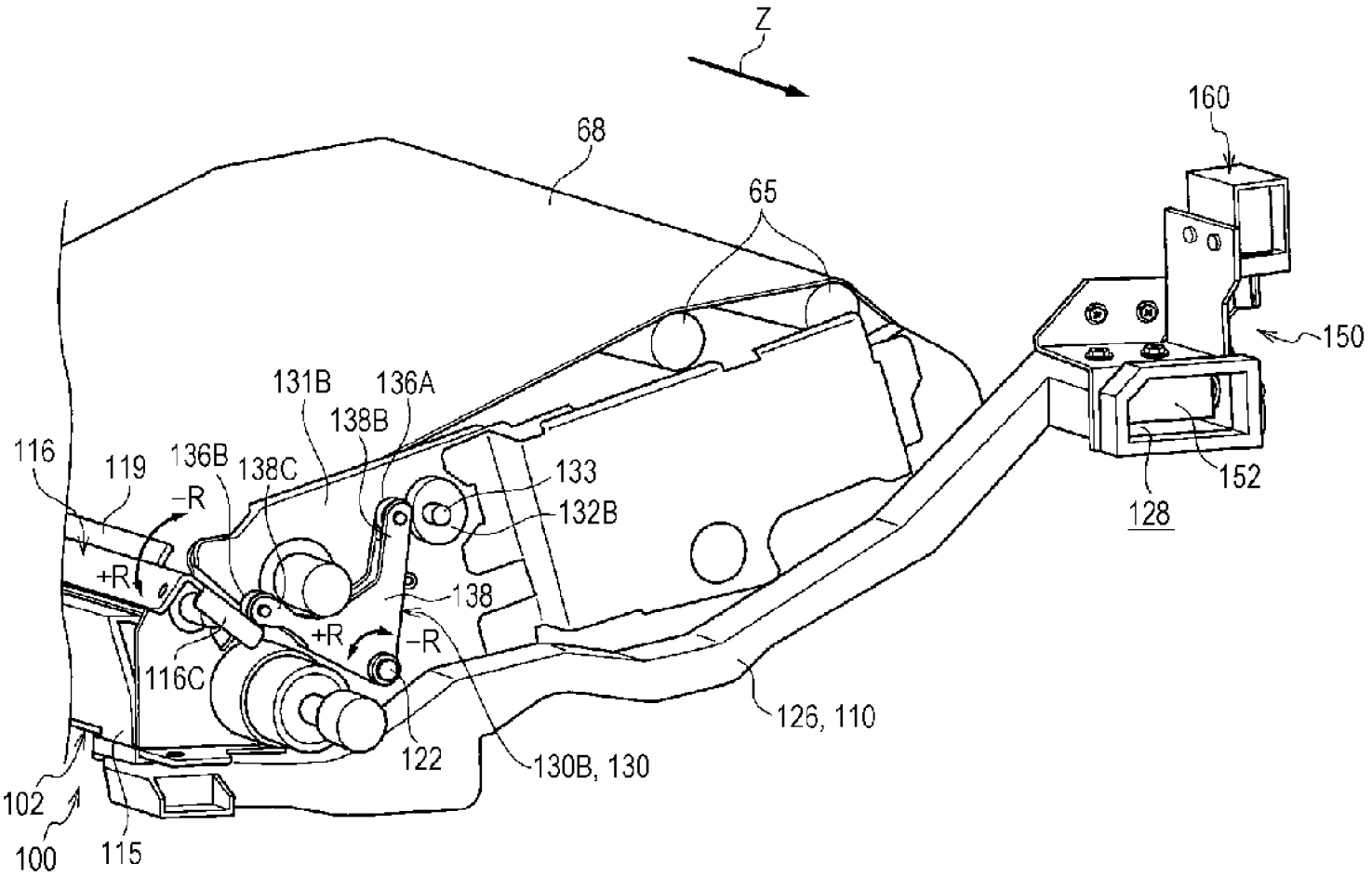
FIG. 8 is a perspective view of the first duct and a shutter mechanism included in the cleaning device according to the exemplary embodiment.

Referring to FIGS. 7 and 8, the second mechanism unit 130B includes an eccentric cam 132B and a link member 138. The eccentric cam 132B is provided outside the side plate 131B and is attached to a second end (back end in the Z-direction) of the shaft member 133 that is rotated by the above-described driving motor. The link member 138 is also provided outside the side plate 131B and is moved in response to a rotation of the eccentric cam 132B, thereby moving the first movable member 116 and the second movable member 120 (see FIGS. 3A to 4B).

The link member 138 has a structure similar to that of the link member 134 (see FIG. 6). The link member 138 rotates around the support shaft 122, which projects from the side plate 131B at the back end thereof, in the +R direction or the −R direction. Accordingly, a first arm 138B and a second arm 138C move in the +R direction or the −R direction.

Similar to the link member 134, when the eccentric cam 132B is not in contact with the link member 138, the link member 138 receives a rotational force in the +R direction. In addition, when the link member 138 is not in the contact state, the first movable member 116 receives a rotational force in the +R direction. The roller 136B is in contact with a contact portion 116C, which is a flat surface of the first movable member 116 provided at the back end thereof.

The roller 136A comes into contact with the eccentric cam 132B when the eccentric cam 132B rotates in the +R direction, and moves away from the eccentric cam 132B when the eccentric cam 132B rotates in the −R direction. When the eccentric cam 132B comes into contact with the roller 136A and moves the link member 138 in the +R direction, the roller 136B pushes the contact portion 116C of the first movable member 116 and moves the first movable member 116 in the −R direction. Then, when the eccentric cam 132B moves away from the roller 136A, the first movable member 116 moves in the +R direction.

Figure 14:
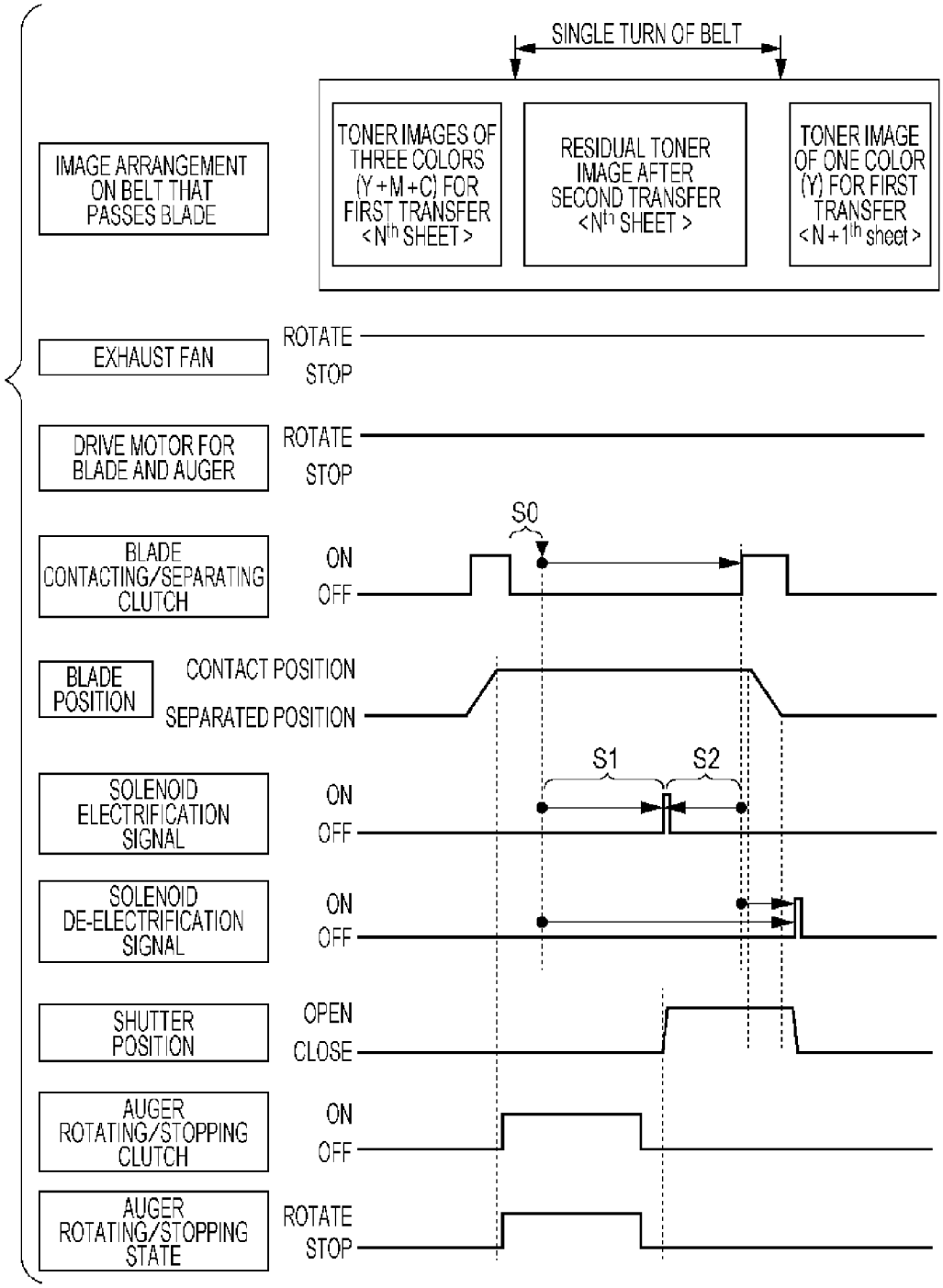
FIG. 14 is a timing chart showing the timing for setting a cleaning blade in a contact or non-contact state, rotating a transporting auger, and opening or closing the shutter mechanism after a second transfer process.

Referring to FIG. 14, the above-described driving motor for rotating the shaft member 133 is continuously rotated while the power of the image forming apparatus 10 is on. When a blade contacting/separating clutch is engaged (turned on), the rotational driving force of the driving motor is transmitted to the shaft member 133. Then, after the eccentric cams 132A and 132B are rotated by 180° against the urging force of the spring 135, the blade contacting/separating clutch is disengaged (turned off). As a result, the eccentric cams 132A and 132B are retained at the those rotational positions.

In this manner, the state in which the link members 134 and 138 are pushed by the eccentric portions of the eccentric cams 132A and 132B, respectively, is maintained from when the first transfer process is started to when the second transfer process is ended. In other words, the retracted state in which the end portions of the cleaning blade 106 and the sealing member 108 are separated from the outer peripheral surface of the intermediate transfer belt 68, as illustrated in FIGS. 4A and 4B, is maintained. In this period, the auger rotating/stopping clutch that transmits the rotational driving force to the transporting auger 121 is disengaged (turned off), so that the transporting auger 121 is stopped.

After the second transfer process is ended, the controller 20 engages (turns on) the blade contacting/separating clutch again. Then, after the eccentric cams 132A and 132B are rotated by 180°, the blade contacting/separating clutch is disengaged (turned off). As a result, the eccentric cams 132A and 132B are returned to the original positions by the restoring force of the spring 135.

In this manner, the state in which the link members 134 and 138 are not pushed by the eccentric portions of the eccentric cams 132A and 132B, respectively, is maintained from when the second transfer process is ended to when the first transfer process for the next sheet (the image forming process for the next sheet) is started. In other words, the state in which the end portions of the cleaning blade 106 and the sealing member 108 are in contact with the outer peripheral surface of the intermediate transfer belt 68, as illustrated in FIGS. 3A and 3B, is maintained.

In this state, the residual toner T that has not been transferred and that remains on the outer peripheral surface of the intermediate transfer belt 68 is removed by the cleaning blade 106 and is collected in the housing 102. At this time, the auger rotating/stopping clutch for the transporting auger 121 is engaged (turned on) so that the transporting auger 121 is rotated. However, the auger rotating/stopping clutch is disengaged (turned off) to stop the rotation of the transporting auger 121 before a first duct 126 is opened by a shutter mechanism 150, which will be described below.

When the first transfer process for the next sheet (the image forming process for the next sheet) is started, the controller 20 engages (turns on) the blade contacting/separating clutch again. Then, after the eccentric cams 132A and 132B are rotated by 180° against the urging force of the spring 135, the blade contacting/separating clutch is disengaged (turned off).

As a result, the eccentric cams 132A and 132B are retained at the those rotational positions again.

Accordingly, the state in which the link members 134 and 138 are pushed by the eccentric portions of the eccentric cams 132A and 132B, respectively, is maintained again from when the first transfer process for the next sheet (the image forming process for the next sheet) is started to when the second transfer process is ended. In other words, the retracted state in which the end portions of the cleaning blade 106 and the sealing member 108 are separated from the outer peripheral surface of the intermediate transfer belt 68 is maintained again.

Referring to FIGS. 7 to 10, the suction unit 110 includes the suction path 115 provided in the housing 102; the first duct 126 having a first end that is connected to a first end of the suction path 115 in the Z-direction at the back side of the image forming apparatus 10; a second duct 144 to which a second end of the first duct 126 (opening 128 which will be described below) is connected; a third duct 146 connected to the bottom end of the second duct 144; and a suction fan unit 148, which is an example of a suction member, attached to the third duct 146.

Referring to FIG. 7, a rectangular opening 124 is formed in the bottom portion of the suction path 115 at the first end thereof in the Z-direction. The first end of the first duct 126 is connected to the rectangular opening 124. Since the opening 124 is formed in the bottom portion of the suction path 115, the air is sucked out of the suction path 115 at a position below the top edge of the partition wall 117A.

Referring to FIG. 8, the first duct 126 has a tubular shape, and is disposed behind the intermediate transfer belt 68 at the back side of the image forming apparatus 10. The opening 128, which is connected to the second duct 144, is provided at the second end of the first duct 126.

Figure 9:
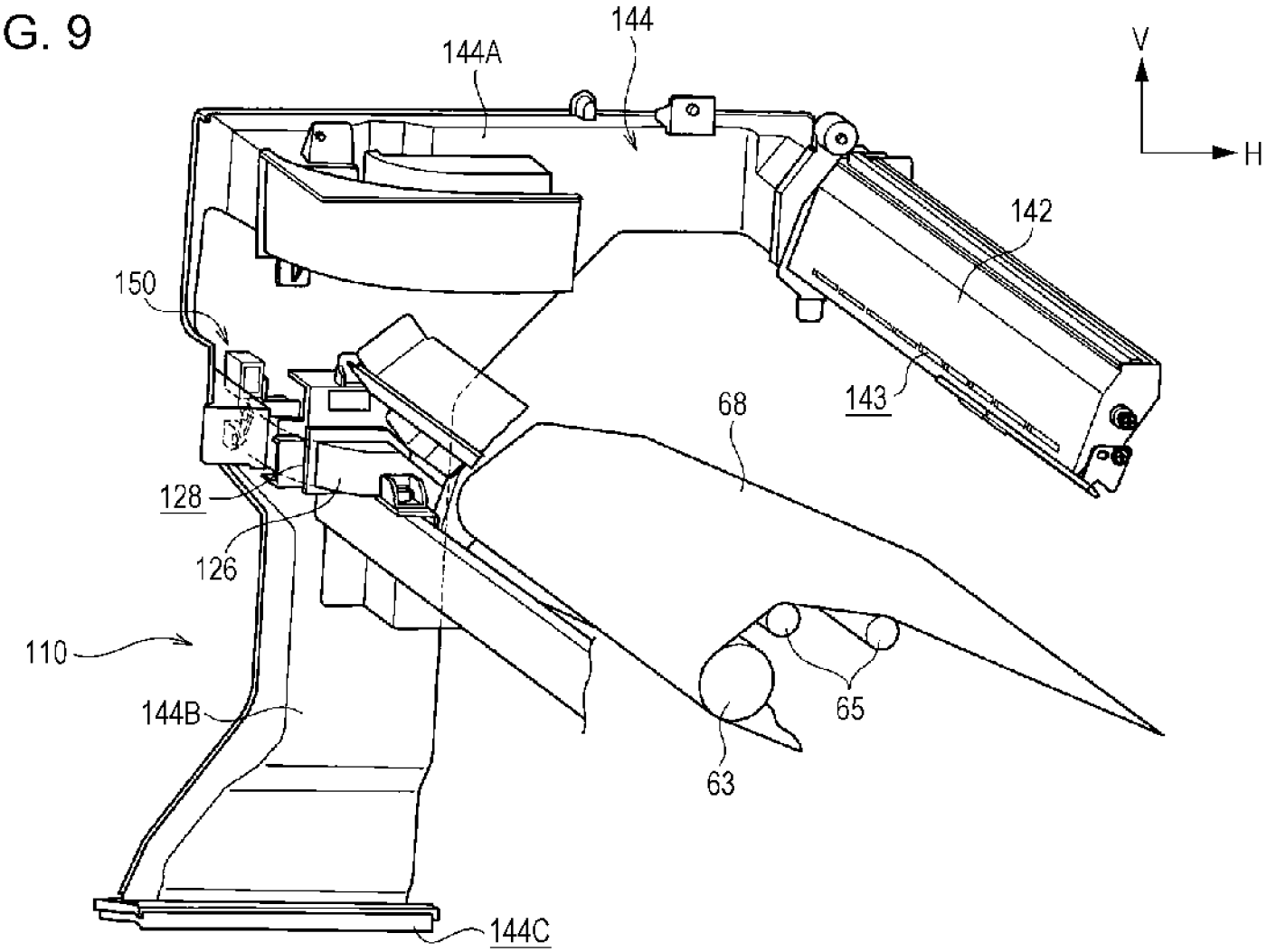
FIG. 9 is a perspective view of a fourth duct provided for a charging device.

Referring to FIG. 9, the second duct 144 is tubular, and is L-shaped as a whole in front view. The second duct 144 includes a horizontal portion 144A that is long in the direction shown by arrow H in front view and a vertical portion 144B that is long in the direction shown by arrow V and extends downward from the left end of the horizontal portion 144A in front view. An opening 144C that is connected to the third duct 146 (see FIG. 10) is provided at the bottom end of the vertical portion 144B. A final filter (not shown) is attached to the opening 144C.

A fourth duct 142, whose longitudinal direction extends in the width direction of the intermediate transfer belt 68, is connected to the right end of the horizontal portion 144A in front view at a position above the intermediate transfer belt 68. The fourth duct 142 has a rectangular parallelepiped shape, and plural openings 143 are formed along the longitudinal direction in a lower portion of a side wall of the fourth duct 142 in the direction shown by arrow H. The fourth duct 142 is located near the charging member 64 (see FIG. 2), and ozone and the like generated during the operation of charging the photoconductor 62 with the charging member 64 are sucked into the fourth duct 142.

Figure 10:
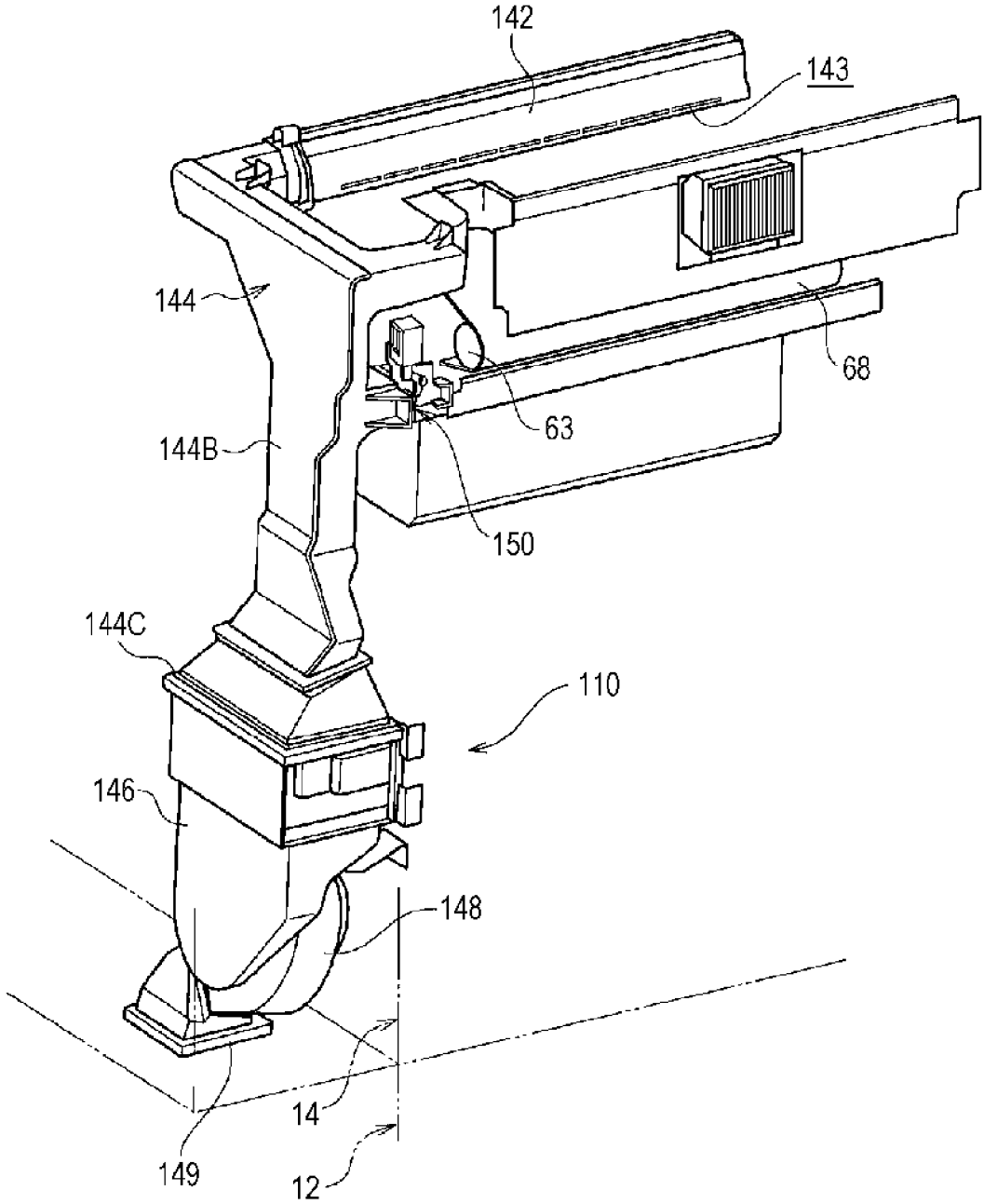
FIG. 10 is a perspective view of a third duct to which a second duct is connected and a fan unit.

Referring to FIG. 10, the third duct 146 is attached to the bottom of the second duct 144. An exhaust opening 149 is provided at the bottom end of the third duct 146, and gas is exhausted through the exhaust opening 149 when a fan (not shown) provided in the fan unit 148 is rotated. The controller 20 (see FIG. 1) controls the fan unit 148 so as to rotate the fan disposed in the fan unit 148 or stop the rotation thereof. As illustrated in FIG. 14, the fan is continuously rotated while the power of the image forming apparatus 10 is on.

The exhaust opening 149 is located at the back side of the image forming apparatus 10 in front view, and opens in the bottom surface of a step portion of the image forming unit 14 that is provided between the image forming unit 14 and the sheet storing unit 12. In the suction unit 110, the inner spaces of the suction path 115, the first duct 126, the second duct 144, the third duct 146, and the fourth duct 142 communicate with each other. The air is sucked out of each part by a negative pressure generated by the operation of the fan unit 148, and is exhausted to the outside of the image forming apparatus 10 through the exhaust opening 149.

As illustrated in FIGS. 8 to 12, the shutter mechanism 150, which is an example of an opening-closing unit, is provided at the opening 128 of the first duct 126. More specifically, referring to FIGS. 11 and 12, the shutter mechanism 150 includes an opening-closing plate 152 capable of setting the opening 128 to an open state or a closed state and a rotational driving unit 154 that rotates the opening-closing plate 152 by substantially 90°.

The opening-closing plate 152 has substantially the same rectangular shape as the cross section of the opening 128, so that the opening 128 of the first duct 126 may be blocked by the opening-closing plate 152. More specifically, the opening-closing plate 152 has a rectangular shape that is long in the horizontal direction in the state in which the opening-closing plate 152 blocks the opening 128. A rotating shaft 153, whose axial direction extends in the longitudinal direction of the opening-closing plate 152, is fixed to and integrated with the opening-closing plate 152 at one side thereof. The rotating shaft 153 is provided at a substantially central position of the opening-closing plate 152 in a direction orthogonal to the longitudinal direction thereof (vertical direction in the state in which the opening 128 is blocked).

The rotating shaft 153, which is fixed to the opening-closing plate 152, projects outward from the first duct 126 at a first end thereof. The rotational driving unit 154 includes a rotating portion 156 that is fixed to the first end of the rotating shaft 153; an arm 158 that is connected to the rotating portion 156 at a first end thereof; a solenoid unit 160 that is connected to a second end of the arm 158; and a torsion spring 164 (see FIG. 12), which is an example of an urging member, that constantly urges the rotating portion 156 so as to retain the rotating portion 156 at the closing position illustrated in FIG. 11.

Figure 11:
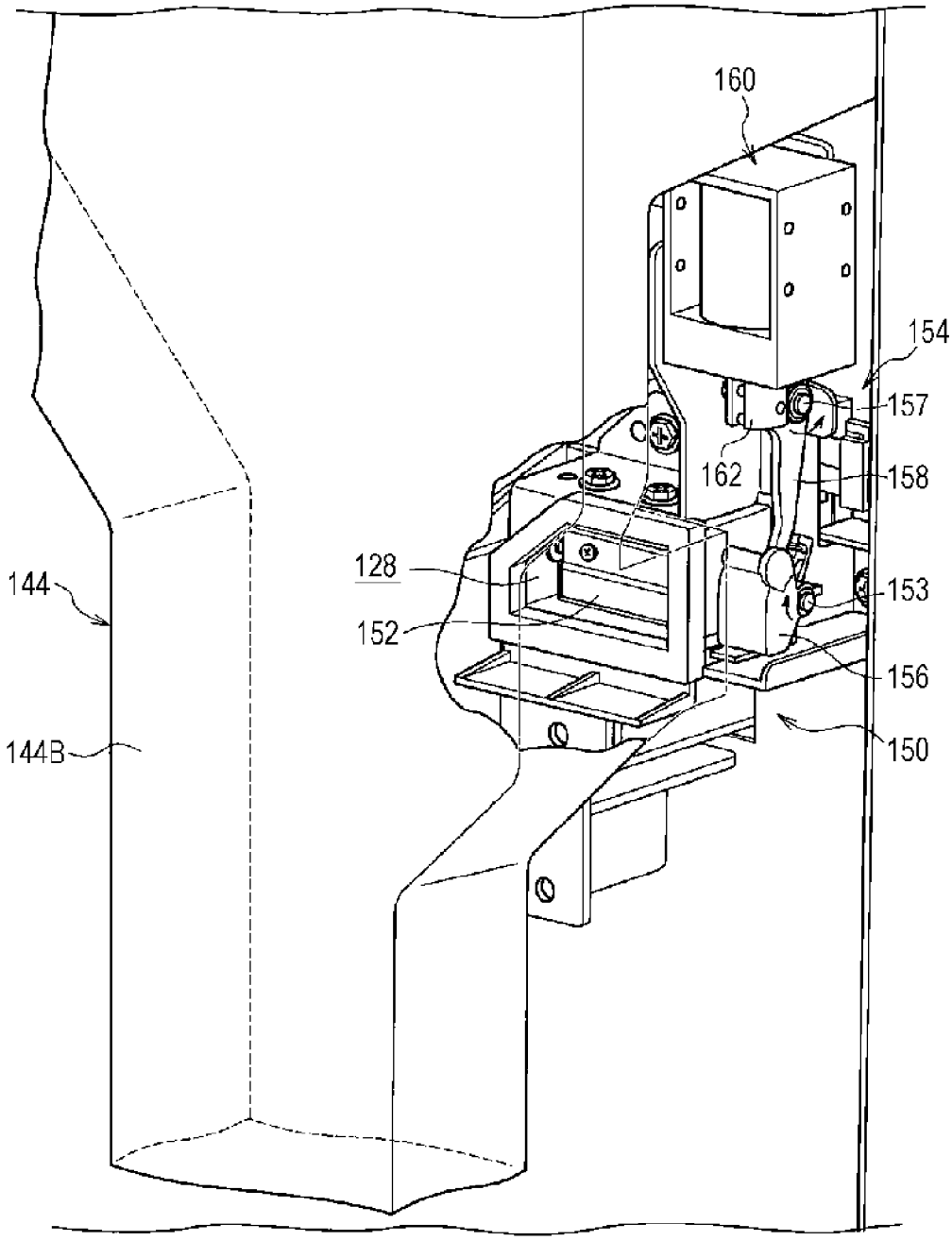
FIG. 11 is a perspective view of the shutter mechanism provided on the first duct of the cleaning device in a closed state.

The rotating portion 156 is rotatable around the rotating shaft 153 in the direction shown by the arrow in FIG. 11. The arm 158 is also rotatable around a rotating shaft 157 in the direction shown by the arrow in FIG. 11. The solenoid unit 160 includes a rod 162 that projects downward when electricity is supplied to the solenoid unit 160. The second end of the arm 158 is connected to the rod 162.

When electricity is not supplied to the solenoid unit 160, the rod 162 is retracted upward, as illustrated in FIG. 11. The initial positions of the rotating portion 156 and the arm 158 with respect to the opening-closing plate 152 are set such that, when the rod 162 is retracted upward, the opening 128 of the first duct 126 is closed by the opening-closing plate 152 owing to the urging force of the torsion spring 164.

Figure 12:
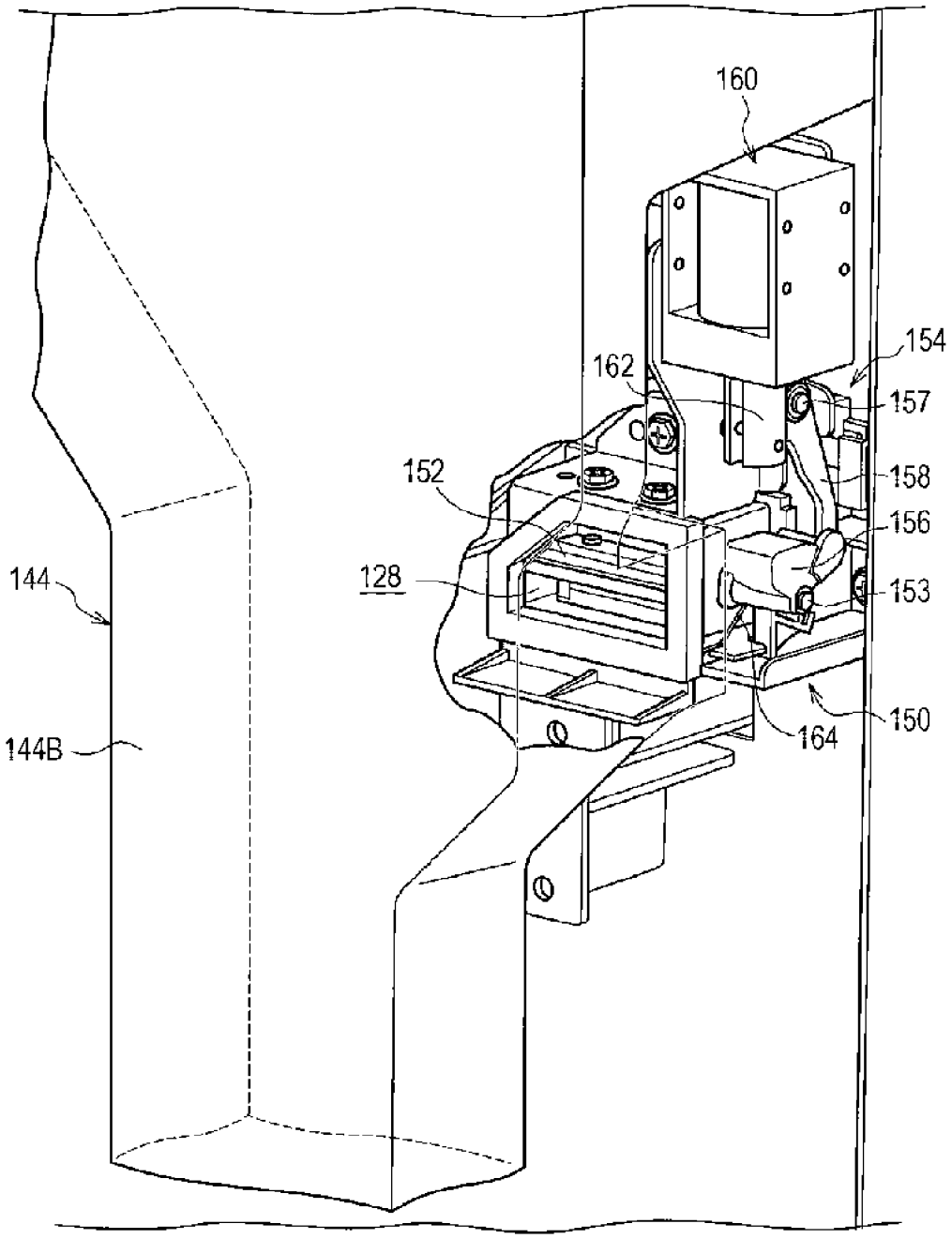
FIG. 12 is a perspective view of the shutter mechanism provided on the first duct of the cleaning device in an open state.

When electricity is supplied to the solenoid unit 160, the rod 162 projects downward, as illustrated in FIG. 12. Accordingly, the arm 158 is rotated around the rotating shaft 157 in the direction shown by the arrow in FIG. 11, and the rotating portion 156 is rotated around the rotating shaft 153 in the direction shown by the arrow in FIG. 11.

The first end of the rotating shaft 153, which is fixed to the opening-closing plate 152, is fixed to the rotating portion 156. Therefore, when the rotating portion 156 is rotated, the opening-closing plate 152 is also rotated. More specifically, the opening-closing plate 152 is rotated by substantially 90° such that the upper portion of the opening-closing plate 152 moves toward the upstream side in the exhausting direction of the first duct 126 and the lower portion of the opening-closing plate 152 moves toward the downstream side in the exhausting direction of the first duct 126. Thus, the opening 128 of the first duct 126 is opened.

The time at which the controller 20 outputs a signal for rotating the opening-closing plate 152 of the shutter mechanism 150 so as to open the opening 128, that is, the time at which electricity is supplied to the solenoid unit 160, is set as follows. That is, as illustrated in FIG. 14, the above-mentioned time is set to be several seconds before separation of the cleaning blade 106 and the sealing member 108 from the outer peripheral surface of the intermediate transfer belt 68 and after stoppage of the transporting auger 121. Accordingly, the opening 128 is opened by the time the cleaning blade 106 and the sealing member 108 are separated from the outer peripheral surface of the intermediate transfer belt 68.

The time that is several seconds before the separation (including the time at which the transporting auger 121 is stopped) is the time after the elapse of a predetermined time period S1 (see FIG. 14) from when the cleaning blade 106 and the sealing member 108 that had been separated from the outer peripheral surface of the intermediate transfer belt 68 came into complete contact therewith. The time period S1 is determined on the basis of the length corresponding to one turn of the intermediate transfer belt 68.

More specifically, the above-mentioned time is the time after the elapse of the predetermined time period S1 from a time point (shown by inverted black triangle in FIG. 14) that is a predetermined time period S0 (including S0=0) after the time when the eccentric cams 132A and 132B were secured at the original positions by the urging force of the spring 135. The eccentric cams 132A and 132B are returned to the original positions when the blade contacting/separating clutch is engaged (turned on) by the controller 20 so as to rotate the eccentric cams 132A and 132B by 180° and is then disengaged (turned off).

Then, immediately after (for example, 0.1 seconds after) the time when the cleaning blade 106 and the sealing member 108 are separated from the outer peripheral surface of the intermediate transfer belt 68 to start the first transfer process again, the controller 20 outputs a signal to stop supplying electricity to the solenoid unit 160. Accordingly, the rotating portion 156 is rotated by the urging force of the torsion spring 164 and the opening-closing plate 152 is rotated so as to close the opening 128. As a result, the operation of sucking the air into the housing 102 is stopped.

The operation of the present exemplary embodiment will now be described. First, an image forming process performed by the image forming apparatus 10 will be described.

Referring to FIG. 1, when the image forming apparatus 10 is activated, image data of respective colors, which are yellow (Y), magenta (M), cyan (C), black (K), the first specific color (E), and the second specific color (F), are successively output to the exposure device 66 from an image processing device (not shown) or an external device. At this time, the developing device 70 is held such that the developing unit 72Y, for example, is opposed to the outer peripheral surface of the photoconductor 62 (see FIG. 2).

As illustrated in FIGS. 4A, 4B, and 14, the cleaning blade 106 and the sealing member 108 in the cleaning device 100 are separated from the outer peripheral surface of the intermediate transfer belt 68 by the operation of the retracting mechanism 130 until the toner images of the respective colors are transferred onto the intermediate transfer belt 68 in a superimposed manner (first transfer process) and then are transferred onto the sheet of recording paper P (second transfer process).

The exposure device 66 emits light in accordance with the image data, and the outer peripheral surface of the photoconductor 62, which has been charged by the charging member 64, is exposed to the emitted light. Accordingly, an electrostatic latent image corresponding to the yellow image data is formed on the outer peripheral surface of the photoconductor 62. The electrostatic latent image formed on the outer peripheral surface of the photoconductor 62 is developed as a yellow toner image by the developing unit 72Y. The yellow toner image on the outer peripheral surface of the photoconductor 62 is transferred onto the intermediate transfer belt 68 by the first transfer roller 67.

Then, referring to FIG. 2, the developing device 70 is rotated by 60° in the direction shown by arrow +R, so that the developing unit 72M is opposed to the outer peripheral surface of the photoconductor 62. Then, the charging process, the exposure process, and the developing process are performed so that a magenta toner image is formed on the outer peripheral surface of the photoconductor 62. The magenta toner image is transferred onto the yellow toner image on the intermediate transfer belt 68 by the first transfer roller 67. Similarly, cyan (C) and black (K) toner images are successively transferred onto the intermediate transfer belt 68, and toner images of the first specific color (E) and the second specific color (F) are multiply transferred onto the intermediate transfer belt 68 depending on the color setting.

A sheet of recording paper P is fed from the sheet storing section 12 and transported along the transport path 28. Then, the sheet is transported by the positioning rollers 38 to the second transfer position in synchronization with the time at which the toner images are transferred onto the intermediate transfer belt 68 in a superimposed manner. Then, the second transfer process is performed in which the toner images that have been transferred onto the intermediate transfer belt 68 in a superimposed manner are transferred by the second transfer roller 71 onto the sheet of recording paper P that has been transported to the second transfer position.

After the second transfer process, as illustrated in FIGS. 3A, 3B, and 14, the cleaning blade 106 and the sealing member 108 in the cleaning device 100 are brought into contact with the outer peripheral surface of the intermediate transfer belt 68 by the operation of the retracting mechanism 130. Then, the residual toner T that remains on the outer peripheral surface of the intermediate transfer belt 68 is removed therefrom by the cleaning blade 106 and collected into the housing 102 (see FIG. 13A).

The sheet of recording paper P onto which the toner images have been transferred is transported toward the fixing device 80 in the direction shown by arrow A (rightward in FIG. 1). The fixing device 80 fixes the toner images on the sheet of recording paper P by applying heat and pressure thereto with the heating roller 82 and the pressing roller 84. The sheet of recording paper P on which the toner images are fixed are ejected to, for example, the paper output unit 15.

When images are to be formed on both sides of the sheet of recording paper P, the following process is performed. That is, after the toner images on the front surface of the sheet of recording paper P are fixed by the fixing device 80, the sheet is transported to the reversing unit 33 in the direction shown by arrow −V. Then, the sheet of recording paper P is transported in the direction shown by arrow +V, so that the leading and trailing edges of the sheet of recording paper P are reversed. Then, the sheet of recording paper P is transported along the reverse transport path 29 in the direction shown by arrow B (leftward in FIG. 1), and is inserted into the transport path 28. Then, the back surface of the sheet of recording paper P is subjected to the image forming process, in which the cleaning blade 106 and the sealing member 108 are set to a retracted state, and the fixing process.

After the fixing process, the cleaning blade 106 and the sealing member 108 are brought into contact with the outer peripheral surface of the intermediate transfer belt 68 by the operation of the retracting mechanism 130. Accordingly, the residual toner T that remains on the outer peripheral surface of the intermediate transfer belt 68 is removed therefrom by the cleaning blade 106 and collected into the housing 102.

The operations of the cleaning device 100 and the suction unit 110 (control of the shutter mechanism 150) will now be described.

After the second transfer process in which the toner images on the intermediate transfer belt 68 are transferred onto the sheet of recording paper P, the residual toner T that has not been transferred remains on the outer peripheral surface of the intermediate transfer belt 68. Accordingly, as illustrated in FIG. 14, the blade contacting/separating clutch is engaged (turned on) by the controller 20 so as to rotate the eccentric cams 132A and 132B by 180° and is then disengaged (turned off), so that the eccentric cams 132A and 132B are returned to the original positions by the urging force of the spring 135.

Figure 13A:
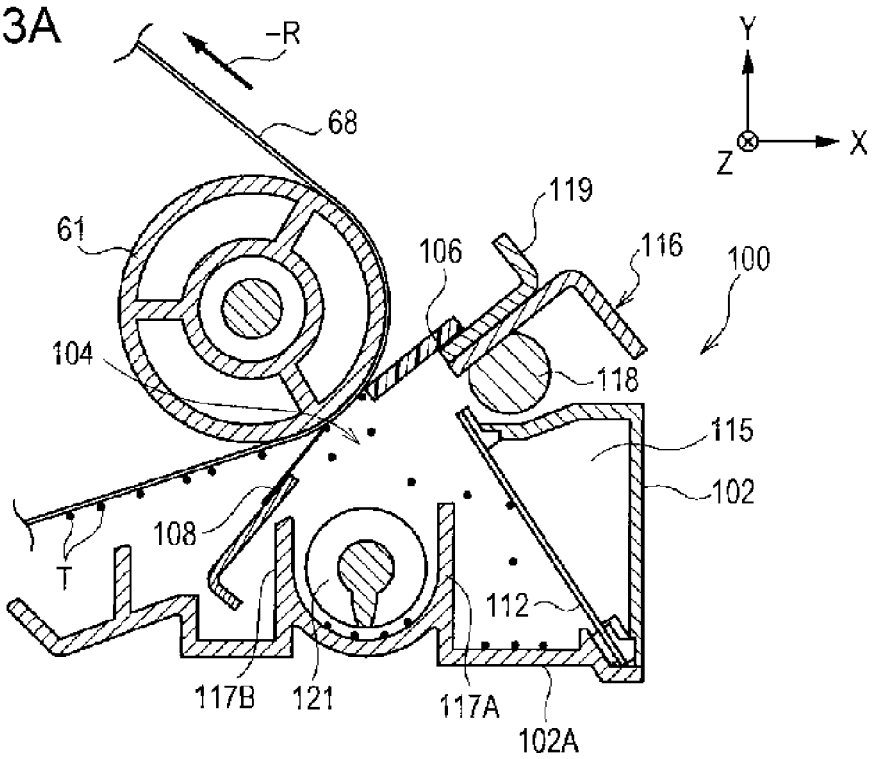
FIG. 13A is a sectional view illustrating the manner in which residual toner is collected when the intermediate transfer belt is in a contact state.

As a result, the cleaning blade 106 and the sealing member 108 come into contact with the outer peripheral surface of the intermediate transfer belt 68. The residual toner T is transported to the cleaning device 100 by the rotation of the intermediate transfer belt 68 in the direction shown by arrow −R. Then, the residual toner T is removed from the outer peripheral surface of the intermediate transfer belt 68 by the cleaning blade 106, and is collected into the housing 102, as illustrated in FIG. 13A.

At this time, the sealing member 108 is also in contact with the outer peripheral surface of the intermediate transfer belt 68 so as to seal the gap between the housing 102 and the sealing member 108. Accordingly, the residual toner T collected in the housing 102 is prevented form leaking to the outside of the housing 102. Since the end portion of the sealing member 108 is pointed toward the downstream in the moving direction of the intermediate transfer belt 68, the sealing member 108 does not remove the residual toner T from the intermediate transfer belt 68.

The signal output by the controller 20 for engaging (turning on) the blade contacting/separating clutch is used as a trigger signal for engaging (turning on) the auger rotating/stopping clutch for the transporting auger 121 to rotate the transporting auger 121 immediately after (for example, 0.1 seconds after) the time when the cleaning blade 106 comes into contact with the intermediate transfer belt 68. Accordingly, the residual toner T removed from the outer peripheral surface of the intermediate transfer belt 68 by the cleaning blade 106 and collected in the housing 102 is transported by the transporting auger 121.

Figure 13B:
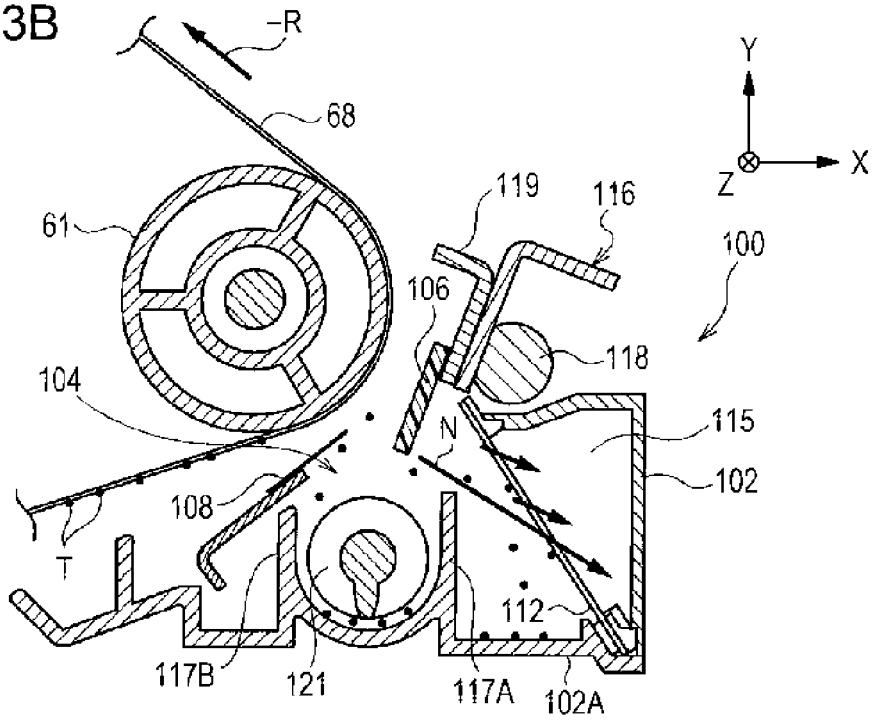
FIG. 13B is a sectional view illustrating the manner in which residual toner is collected when the intermediate transfer belt is in a non-contact state.

Then, when the image forming apparatus 10 starts the image forming process for the next sheet, the cleaning blade 106 and the sealing member 108 are separated from the outer peripheral surface of the intermediate transfer belt 68, as illustrated in FIG. 13B. Before the separation, the shutter mechanism 150 is operated so as to open the first duct 126.

More specifically, as illustrated in FIG. 14, the controller 20 engages (turns on) the blade contacting/separating clutch again to rotate the eccentric cams 132A and 132B by 180° against the urging force of the spring 135, so that the cleaning blade 106 and the sealing member 108 are separated from the outer peripheral surface of the intermediate transfer belt 68. Here, electricity is supplied to the solenoid unit 160 to rotate the opening-closing plate 152 several seconds before the separation.

The shutter mechanism 150 is operated at the time after the elapse of the predetermined time period S1 from the time point that is the predetermined time period S0 after the time when the cleaning blade 106 and the sealing member 108 that had been separated from the outer peripheral surface of the intermediate transfer belt 68 came into complete contact therewith (more specifically, from when the blade contacting/separating clutch was disengaged). The time period S1 is determined on the basis of the length corresponding to one turn of the intermediate transfer belt 68.

As illustrated in FIG. 14, the fan unit 148 in the suction unit 110 is constantly driven. Therefore, when the opening-closing plate 152 of the shutter mechanism 150 is rotated so as to open the opening 128 in the first duct 126, the pressure in the inner spaces of the suction path 115 and the housing 102 are set to a negative pressure, and the air is sucked into the suction path 115 from the housing 102. Accordingly, a flow of air (airflow) from the opening 104 to the filter 112 is generated in the direction shown by arrow N (direction toward the lower right in the X-Y plane). The filter 112 is long in the longitudinal direction of the housing 102, and is disposed in the housing 102 in an inclined manner.

Therefore, the residual toner T that is removed from the outer peripheral surface of the intermediate transfer belt 68 by the cleaning blade 106 and the sealing member 108 is carried by the airflow and is caught by the filter 112. Alternatively, the residual toner T falls to the space between the filter 112 and the partition wall 117A and is collected in the housing 102. As a result, the risk that residual toner T will scatter and adhere to the outer peripheral surface of the intermediate transfer belt 68 again may be reduced.

As illustrated in FIG. 14, the auger rotating/stopping clutch for the transporting auger 121 is disengaged (turned off) by the controller 20 to stop the rotation of the transporting auger 121 immediately before the shutter mechanism 150 is operated. Thus, the controller 20 stops the transporting auger 121 several seconds before the time period S1 elapses. Accordingly, the possibility that the residual toner T that is transported by the transporting auger 121 will be caught by the filter 112 is reduced. As a result, the life of the filter 112 may be increased.

When the cleaning blade 106 and the sealing member 108 are removed from the outer peripheral surface of the intermediate transfer belt 68 to start the image forming process for the next sheet, the supply of electricity to the solenoid unit 160 is stopped by the controller 20. Accordingly, the opening-closing plate 152 is rotated by the urging force of the torsion spring 164 so as to close the opening 128 of the first duct 126. Thus, the time of the suction operation is not excessively increased, so that clogging of the filter 112 is suppressed. In addition, the risk that the toner which is not necessary to be sucked in (collected) by the cleaning device 100 (toner that is not scattered) will be sucked in (collected) may be reduced.

As described above, the shutter mechanism 150 is operated (the opening-closing plate 152 is opened) several seconds before the cleaning blade 106 and the sealing member 108 are separated from the outer peripheral surface of the intermediate transfer belt 68. Referring to Table 1, the lead time S2 (see FIG. 14) before the separation may be about 1.5 seconds. In Table 1, the filter life is the life of the final filter provided at the opening 144C. The values in Table 1 are obtained in an environment with a temperature of 10° C. and a humidity of 15%, where the residual toner T relatively easily scatter. The filter life was evaluated as "Good" if the resulting value was 5 or more, as "Fair" if 3 or more and less than 5, and "Bad" if less than 3. The dot-shaped toner stain was evaluated as "Good" if the resulting value was 0.5 or less, as "Fair" if 1 or less and more than 0.5, and "Bad" if more than 1.

TABLE 1

| | Shutter timing | Test result | | | |
|---|---|---|---|---|---|
| | Close-to-open | Filter life (×ten thousand sheets) | | Dot-shaped toner stain (number per sheet) | |
| Shutter conditions | solenoid lead time S2 (sec) | Result | Evaluation result | Result | Evaluation result |
| Constantly closed | | 15.0 | Good | 2.5 | Bad |
| Constantly opened | | 1.8 | Bad | 0.2 | Good |
| Opened or closed in association with blade movement | 0 | 12.0 | Good | 1.5 | Bad |
| | 1 | 7.0 | Good | 0.7 | Fair |
| | 1.5 | 6.1 | Good | 0.4 | Good |
| | 2 | 3.8 | Fair | 0.3 | Good |

Although the image forming apparatus 10 according to the present exemplary embodiment is described above with reference to the drawings, an image forming apparatus according to an exemplary embodiment of the present invention is not limited to the image forming apparatus 10 illustrated in the drawings, and various design changes may be made within the scope of the present invention.

For example, the reference for determining the time at which the shutter mechanism 150 is to be operated is not limited to disengaging of the blade contacting/separating clutch. In addition, the position at which the shutter mechanism 150 is provided is not limited to the illustrated position. The shutter mechanism 150 may be provided at any position between the suction path 115 of the housing 102 that is downstream of the filter 112 in the exhausting direction and the opening 128 of the first duct 126.

In the present exemplary embodiment, the time at which the shutter mechanism 150 is operated (the time at which the opening-closing plate 152 is opened or closed) is determined in association with the time at which the transporting auger 121 is rotated or stopped. However, the time at which the shutter mechanism 150 is operated may be determined irrespective of the time at which the transporting auger 121 is rotated or stopped.

When the transporting auger 121 is rotated, the opening 128 of the first duct 126 is closed by the shutter mechanism 150 and the airflow toward the filter 112 is not generated in the housing 102. Therefore, there is a risk that the residual toner T removed by the cleaning blade 106 will scatter and adhere to the outer peripheral surface of the intermediate transfer belt 68 again. However, since the cleaning blade 106 is in contact with the outer peripheral surface of the cleaning blade 106 at that time, the residual toner T may be removed by the cleaning blade 106 again.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a housing provided with an opening opposed to a developer carrying member that carries and transports developer;

a collecting member provided along an edge of the opening at a downstream end of the opening in a transporting direction, in which the developer carrying member transports the developer, the collecting member being capable of coming into contact with and separating from the developer carrying member;

a sealing member provided along an edge of the opening at an upstream end of the opening in the transporting direction;

a suction member that sucks air from the opening;

a suction path provided between the opening and the suction member;

an opening-closing unit provided in the suction path, the opening-closing unit opening or closing the suction path; and a controller that controls the opening-closing unit so as to open the suction path from a closed state at a time that is before separation of the collecting member from the developer carrying member and a predetermined time period after the time of contact between the collecting member and the developer carrying member.

2. The image forming apparatus according to claim 1, further comprising:

a developer transporting unit that transports the developer collected in the housing, wherein the controller controls the opening-closing unit so as to open the suction path from the closed state after stopping the developer transporting unit.

3. The image forming apparatus according to claim 1, wherein the controller controls the opening-closing unit so as to close the suction path from an opened state at a time that is after separation of the collecting member from the developer carrying member.

4. The image forming apparatus according to claim 1, wherein the developer is a toner.

5. The image forming apparatus according to claim 1, wherein the developer carrying member is an intermediate transfer belt.

6. The image forming apparatus according to claim 1, wherein the collecting member is a cleaning blade that cleans a residual toner that is on the outer peripheral surface of the developer carrying member.

7. The image forming apparatus according to claim 1, further comprising:

a filter member that is disposed between the opening and the suction path.

8. The image forming apparatus according to claim 1, wherein developer images are multiply transferred onto the developer carrying member.

9. The image forming apparatus according to claim 1, wherein the opening-closing unit comprises a plate.

10. The image forming apparatus according to claim 9, wherein the plate is moveable between the closed state that closes the suction path to prevent air from passing through the suction path and an open state that opens the suction path to allow air to pass through the suction path and.

11. The image forming apparatus according to claim 1, wherein the controller controls the opening-closing unit so as to close the suction path from the open state at times other than the time.

12. The image forming apparatus according to claim 1, wherein the opening-closing unit is biased in the closed state.

13. An image forming method for an image forming apparatus including a housing provided with an opening opposed to a developer carrying member that carries and transports developer;

a collecting member provided along an edge of the opening at a downstream end of the opening in a transporting direction in which the developer carrying member transports the developer, the collecting member being capable of coming into contact with and separating from the developer carrying member;

a sealing member provided along an edge of the opening at an upstream end of the opening in the transporting direction; a suction member that at least sucks the developer removed from the developer carrying member into the housing;

a suction path provided between the opening and the suction member; and an opening-closing unit provided in the suction path, the opening-closing unit opening or closing the suction path, the method comprising:

controlling the opening-closing unit so as to open the suction path from a closed state at a time that is before separation of the collecting member from the developer carrying member and a predetermined time period after the time of contact between the collecting member and the developer carrying member.

14. The image forming method for an image forming apparatus according to claim 13, further comprising:

controlling the opening-closing unit so as to open the suction path from the closed state after stopping a developer transporting unit, the developer transporting unit transporting the developer collected in the housing.

15. The image forming method for an image forming apparatus according to claim 13, further comprising:

controlling the opening-closing unit so as to close the suction path from an opened state at a time that is after separation of the collecting member from the developer carrying member.

* * * * *